US010553080B2

(12) United States Patent
Berman

(10) Patent No.: US 10,553,080 B2
(45) **Date of Patent: *Feb. 4, 2020**

(54) SYSTEMS, APPARATUSES AND METHODS FOR ENHANCING GAMING EXPERIENCES

(71) Applicant: KING SHOW GAMES, INC., Minnetonka, MN (US)

(72) Inventor: Bradley Berman, Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/431,731

(22) Filed: Feb. 13, 2017

(65) Prior Publication Data

US 2017/0154502 A1 Jun. 1, 2017

Related U.S. Application Data

(63) Continuation of application No. 13/952,273, filed on Jul. 26, 2013, now Pat. No. 9,569,934, which is a continuation-in-part of application No. 13/938,178, filed on Jul. 9, 2013, now Pat. No. 9,576,437, which is a continuation-in-part of application No. 12/850,826, filed on Aug. 5, 2010, now Pat. No. 9,576,431.

(60) Provisional application No. 61/708,183, filed on Oct. 1, 2012, provisional application No. 61/231,951, filed on Aug. 6, 2009.

(51) Int. Cl.
*G07F 17/32* (2006.01)

(52) U.S. Cl.
CPC ..... *G07F 17/3293* (2013.01); *G07F 17/3244* (2013.01); *G07F 17/3262* (2013.01); *G07F 17/3267* (2013.01)

(58) Field of Classification Search
CPC .... G07F 17/32; G07F 17/326; G07F 17/3267; G07F 17/3293
See application file for complete search history.

(56) References Cited

U.S. PATENT DOCUMENTS

| | | | | |
|---|---|---|---|---|
| 5,788,573 | A | 8/1998 | Baerlocher et al. | |
| 5,823,873 | A | 10/1998 | Moody | |
| 6,007,066 | A | 12/1999 | Moody | |
| 6,098,985 | A | 8/2000 | Moody | |
| 6,190,255 | B1 * | 2/2001 | Thomas | G07F 17/32 463/20 |
| 6,213,876 | B1 | 4/2001 | Moore | |
| 6,224,483 | B1 | 5/2001 | Mayeroff | |
| 6,334,814 | B1 | 1/2002 | Adams | |
| 6,517,074 | B1 | 2/2003 | Moody et al. | |
| 6,612,927 | B1 | 9/2003 | Slomiany et al. | |
| 6,652,377 | B1 | 11/2003 | Moody | |

(Continued)

*Primary Examiner* — Jasson H Yoo

(57) ABSTRACT

Systems, apparatuses and methods for enhancing winning result opportunities in gaming activities. Embodiments involve identifying award-enhancing opportunities using dice during a current game to determine award-enhancing opportunities for subsequent games based on the dice results. Award-enhancing opportunities may continue over multiple games until a terminating condition is activated, or single bonus rolls of dice may be used to determine multipliers or other modifiers to enhance awards only in a single subsequent game. The award-enhancing opportunities may be triggered by a mystery or random selection process, or may be based on at least a portion of the outcome of the current game.

16 Claims, 22 Drawing Sheets

(56) References Cited

U.S. PATENT DOCUMENTS

| | | | | |
|---|---|---|---|---|
| 7,247,092 | B2 | 7/2007 | Jarvis et al. | |
| 7,354,342 | B2 | 4/2008 | Paulsen et al. | |
| 8,147,310 | B2 | 4/2012 | Jarvis et al. | |
| 8,419,518 | B2 | 4/2013 | Jarvis et al. | |
| 8,439,737 | B1 | 5/2013 | Moody | |
| 8,668,573 | B1 | 3/2014 | Mayeroff | |
| 9,569,934 | B2 * | 2/2017 | Berman | G07F 17/3293 |
| 9,576,437 | B2 * | 2/2017 | Berman | G07F 17/3293 |
| 10,008,075 | B2 * | 6/2018 | Berman | G07F 17/3293 |
| 2002/0082074 | A1 * | 6/2002 | Bennett | G07F 17/34 463/20 |
| 2003/0064790 | A1 | 4/2003 | Hughs-Baird et al. | |
| 2003/0071417 | A1 * | 4/2003 | Webb | A63F 3/00157 273/292 |
| 2004/0002376 | A1 | 1/2004 | Swift et al. | |
| 2004/0152498 | A1 | 8/2004 | Kaminkow et al. | |
| 2004/0229670 | A1 | 11/2004 | Potter et al. | |
| 2005/0148383 | A1 | 7/2005 | Mayeroff | |
| 2005/0173863 | A1 * | 8/2005 | Walker | G07F 17/3293 273/292 |
| 2006/0040723 | A1 | 2/2006 | Baerlocher et al. | |
| 2006/0063584 | A1 | 3/2006 | Brill et al. | |
| 2006/0160595 | A1 | 7/2006 | Gerson et al. | |
| 2007/0167208 | A1 | 7/2007 | Acres | |
| 2008/0113760 | A1 | 5/2008 | Baerlocher | |
| 2008/0146305 | A1 | 6/2008 | Moody | |
| 2009/0111556 | A1 | 4/2009 | Moody | |
| 2009/0117993 | A1 | 5/2009 | Bigelow et al. | |
| 2009/0258695 | A1 | 10/2009 | Graham et al. | |
| 2011/0034233 | A1 | 2/2011 | Berman et al. | |
| 2011/0312409 | A1 | 12/2011 | Vancura | |
| 2013/0029750 | A1 | 1/2013 | Moody | |
| 2013/0217457 | A1 | 8/2013 | Jarvis et al. | |

* cited by examiner

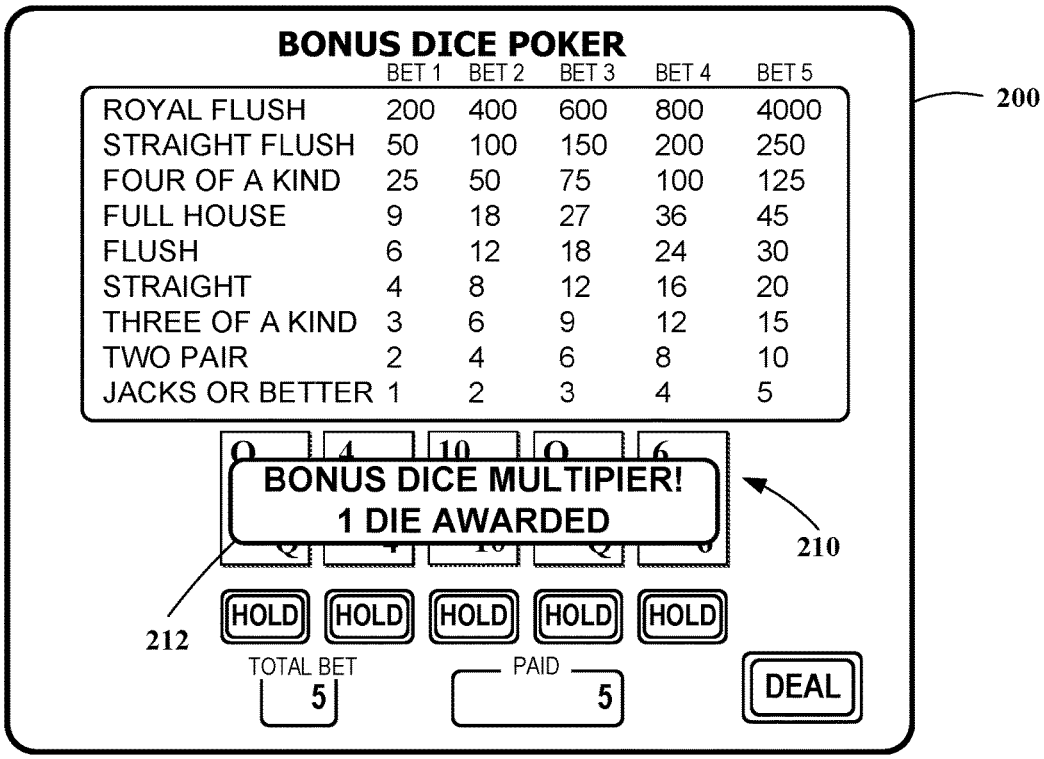
FIG. 2A
FIG. 2B
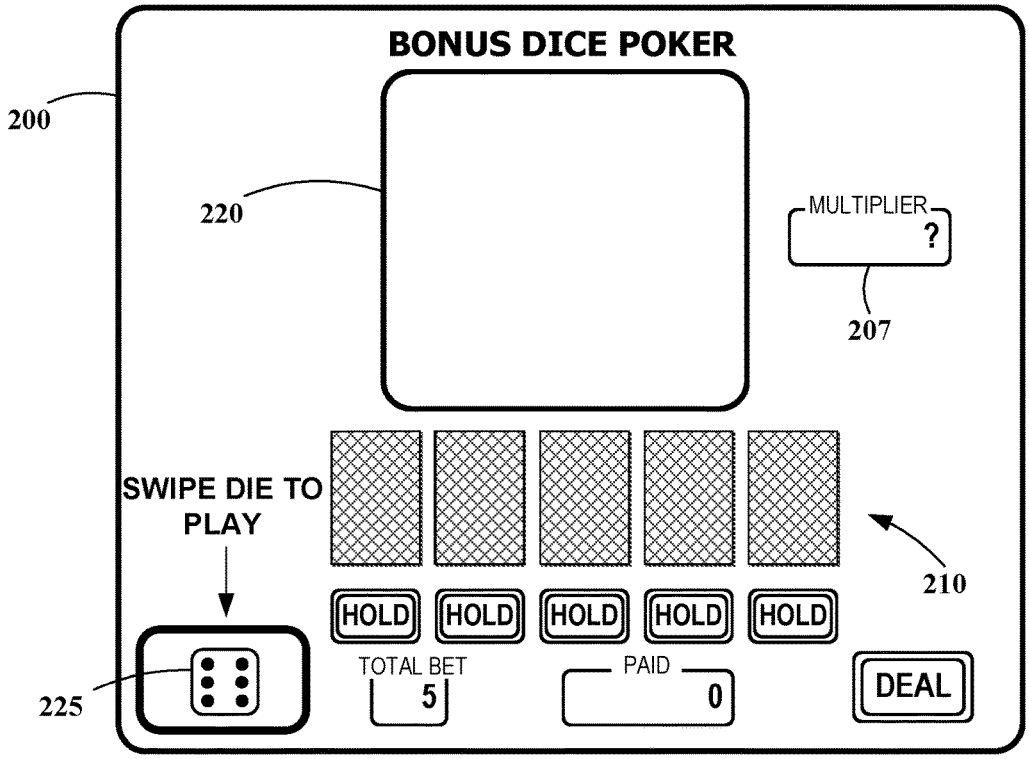

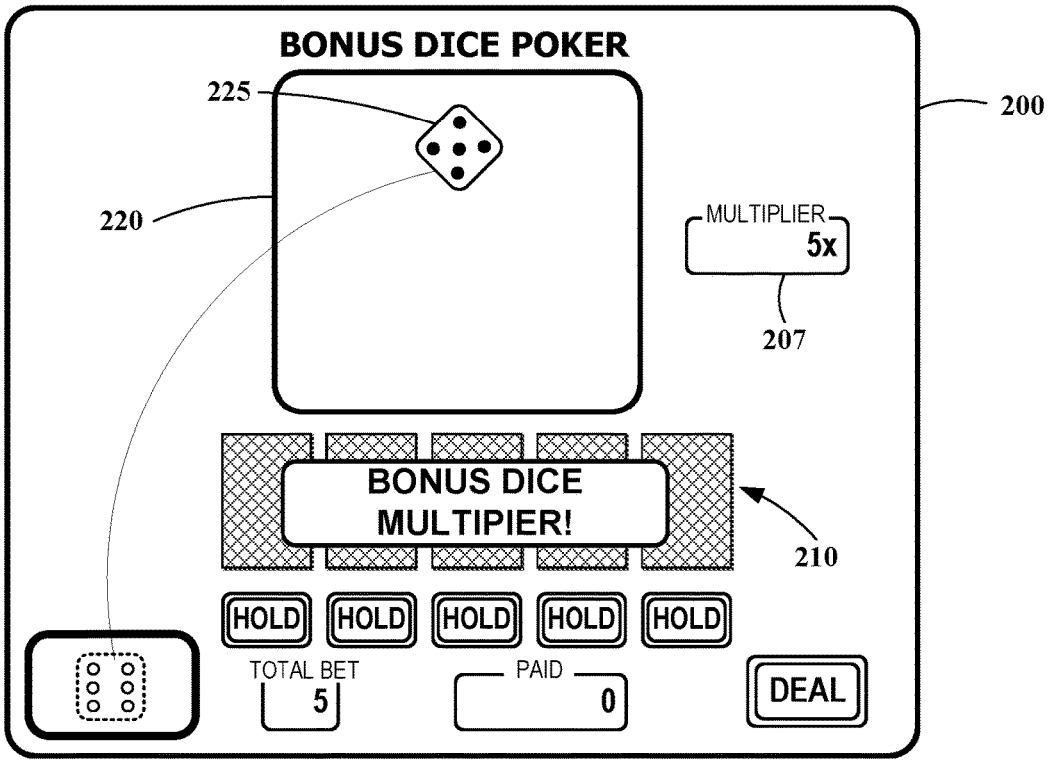
FIG. 2C
FIG. 2D
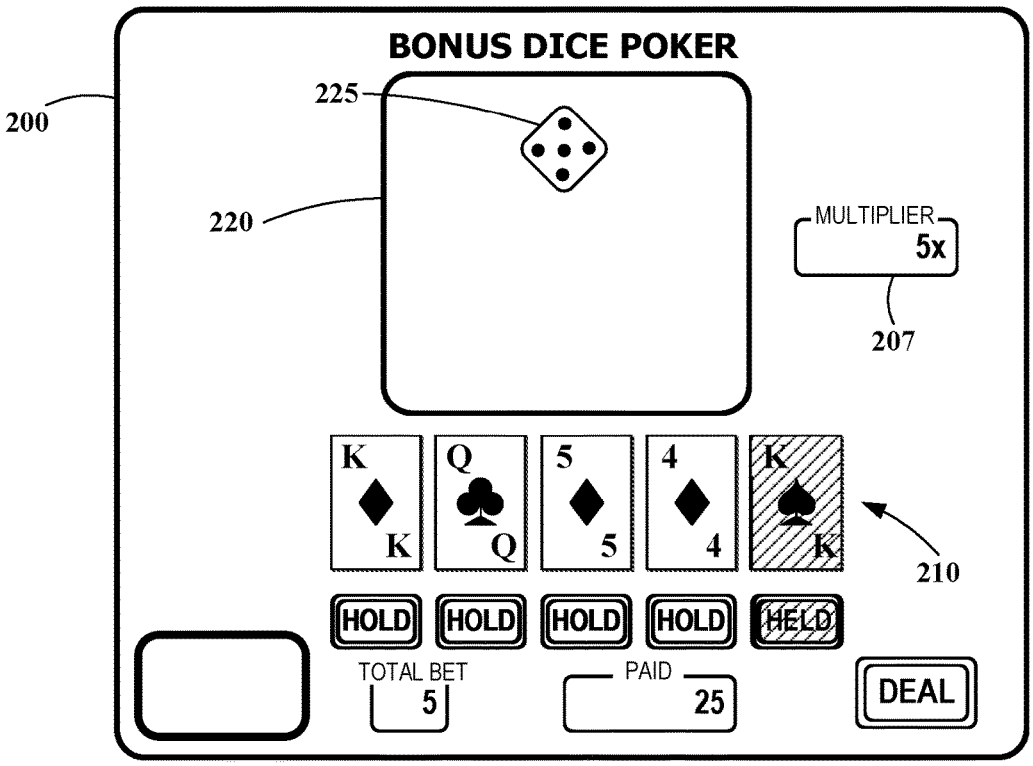

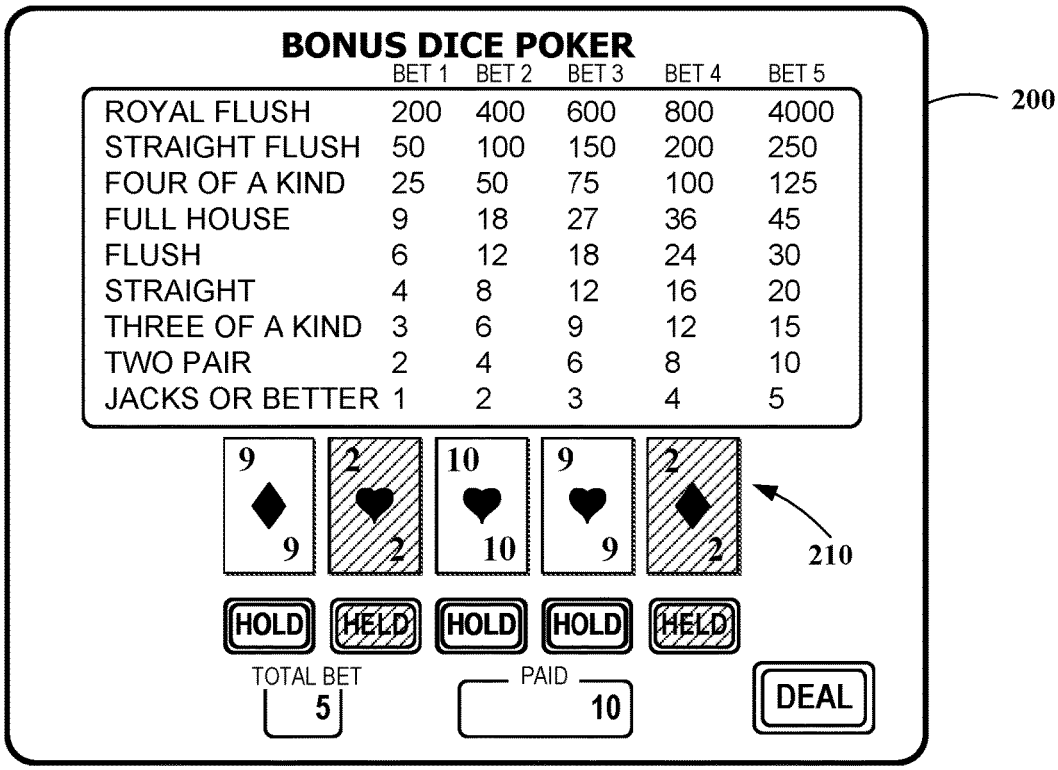
FIG. 2E
FIG. 2F
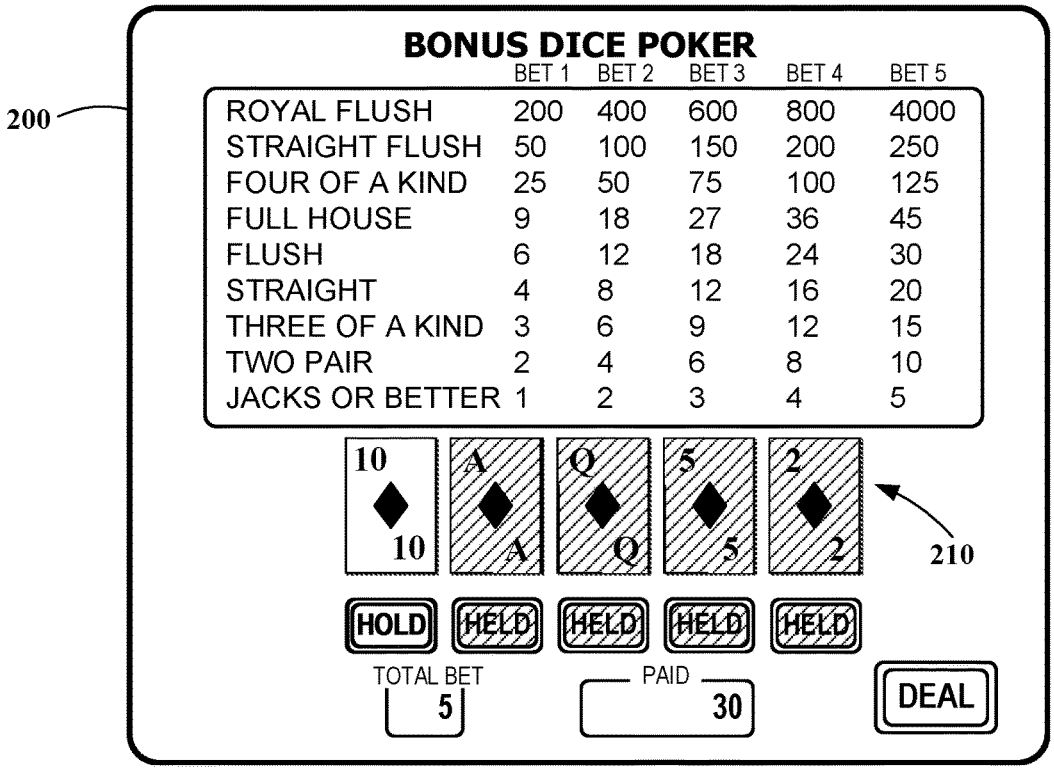

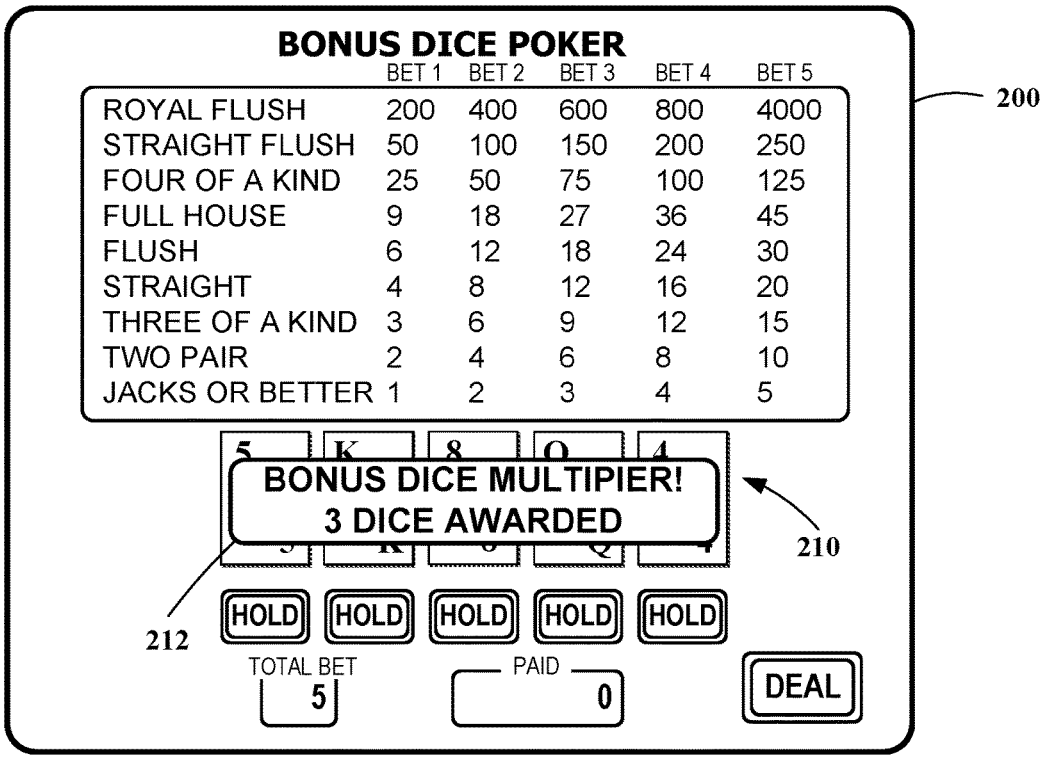
FIG. 2G
FIG. 2H
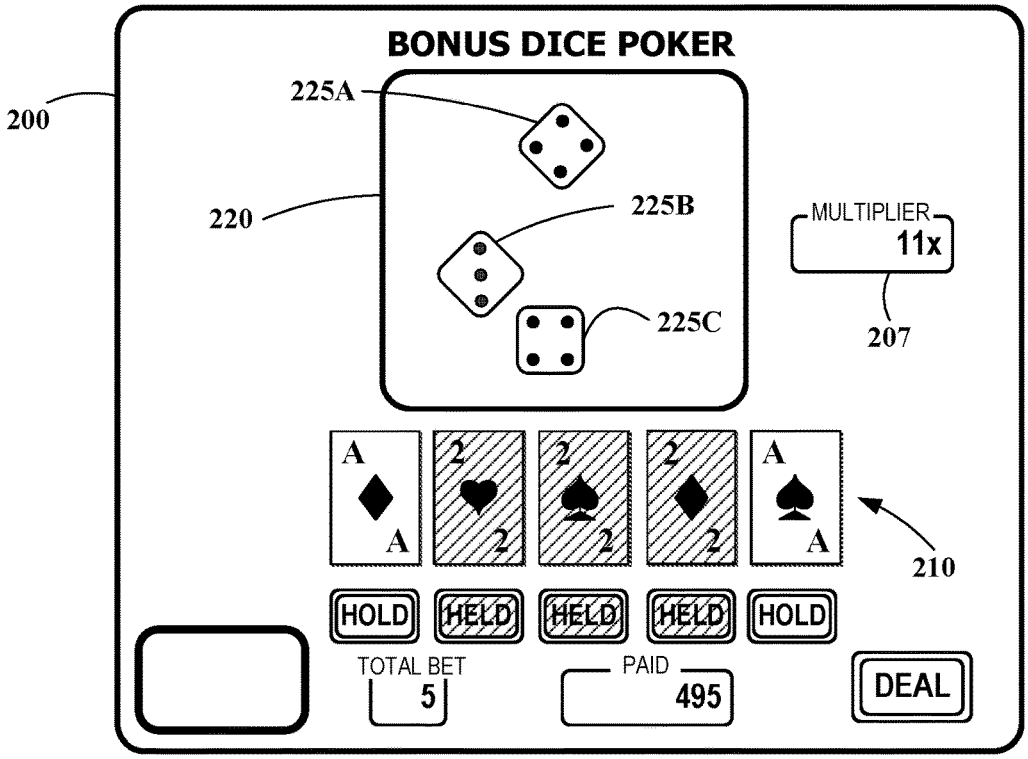

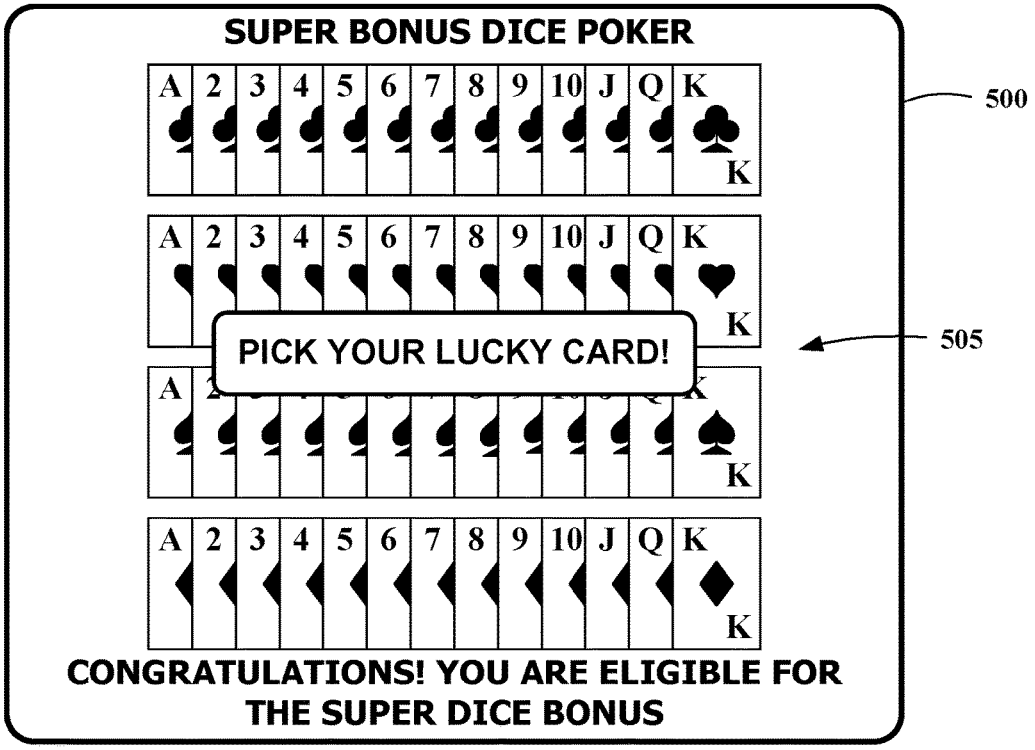
FIG. 5A
FIG. 5B
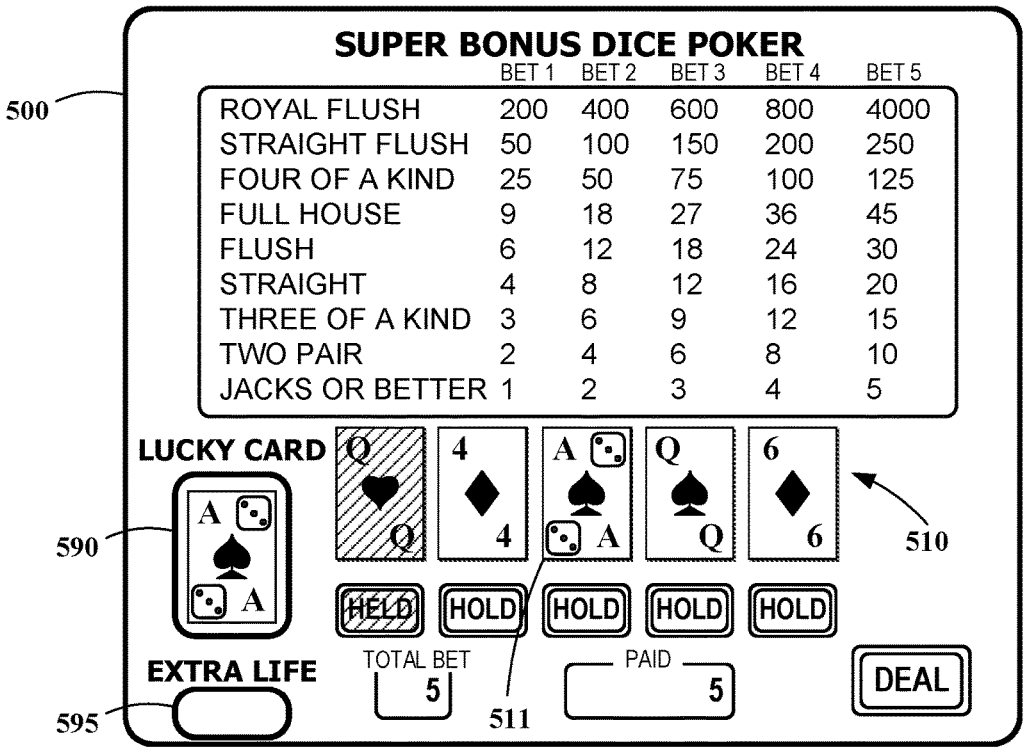

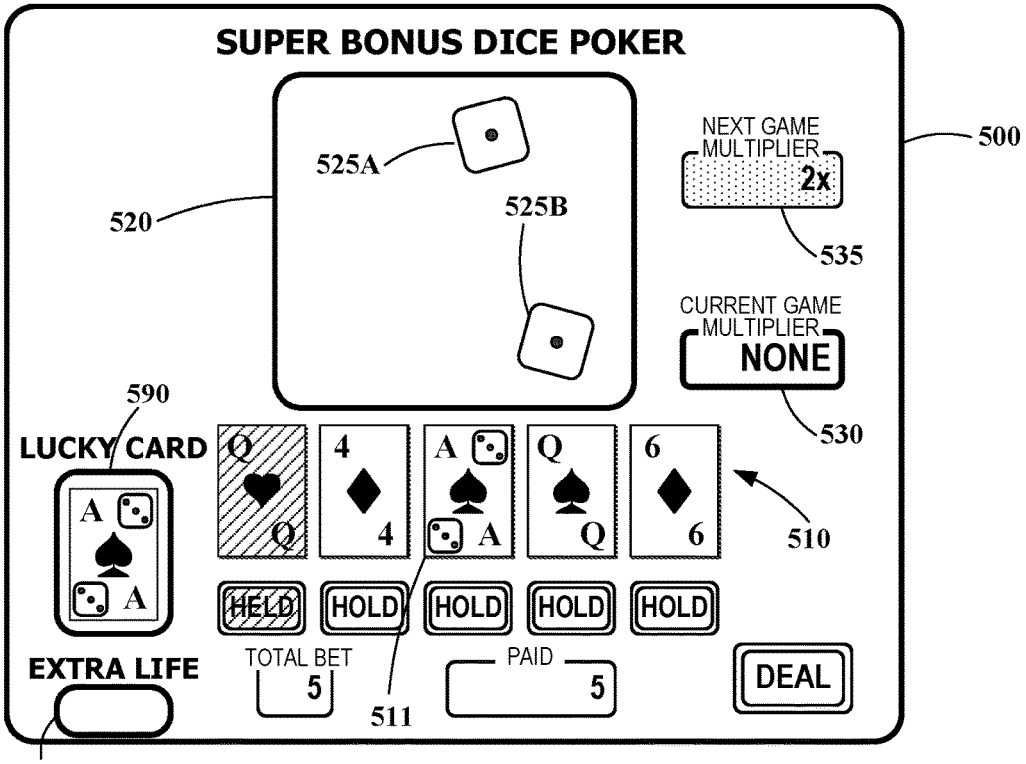
FIG. 5C
FIG. 5D
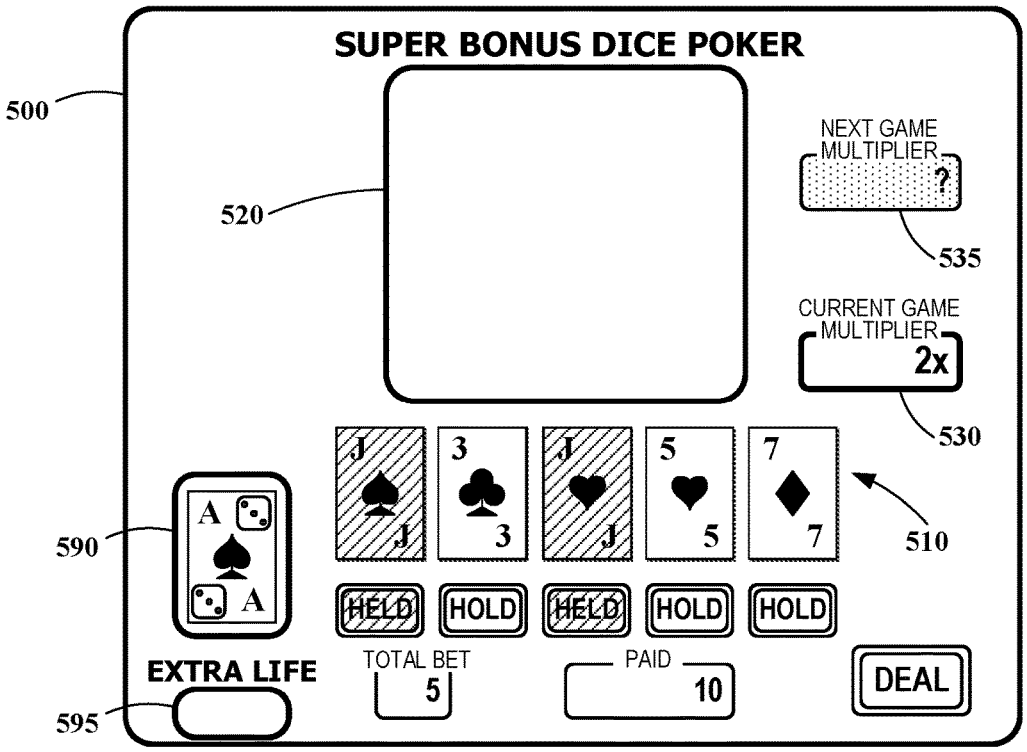

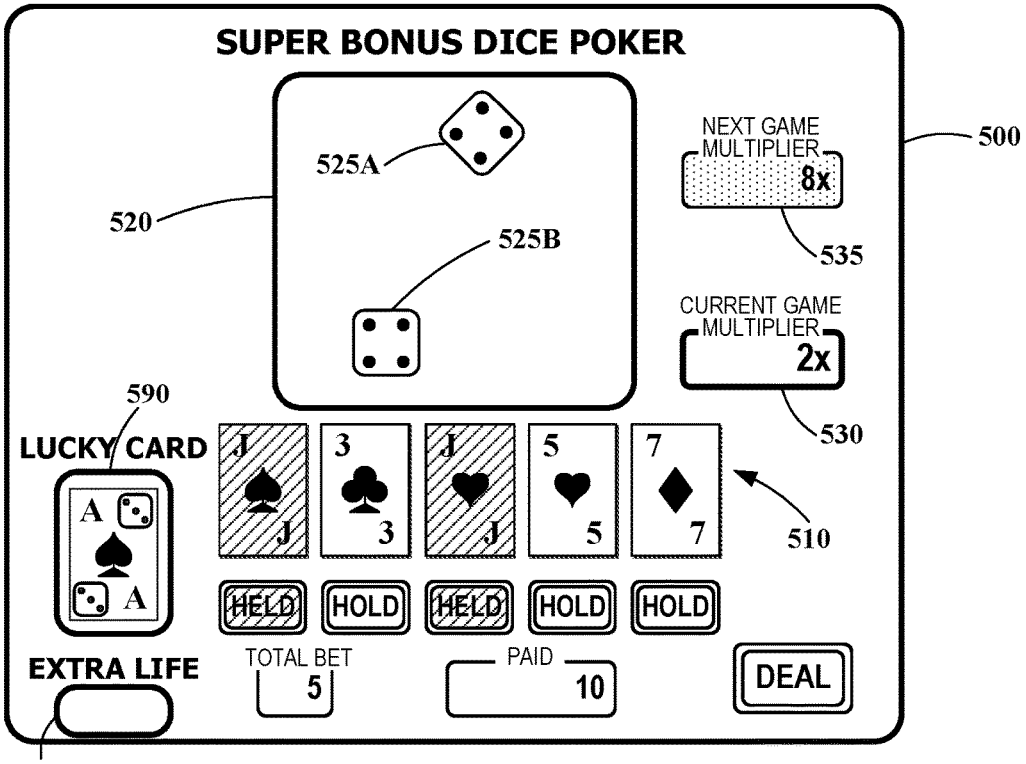
FIG. 5E
FIG. 5F
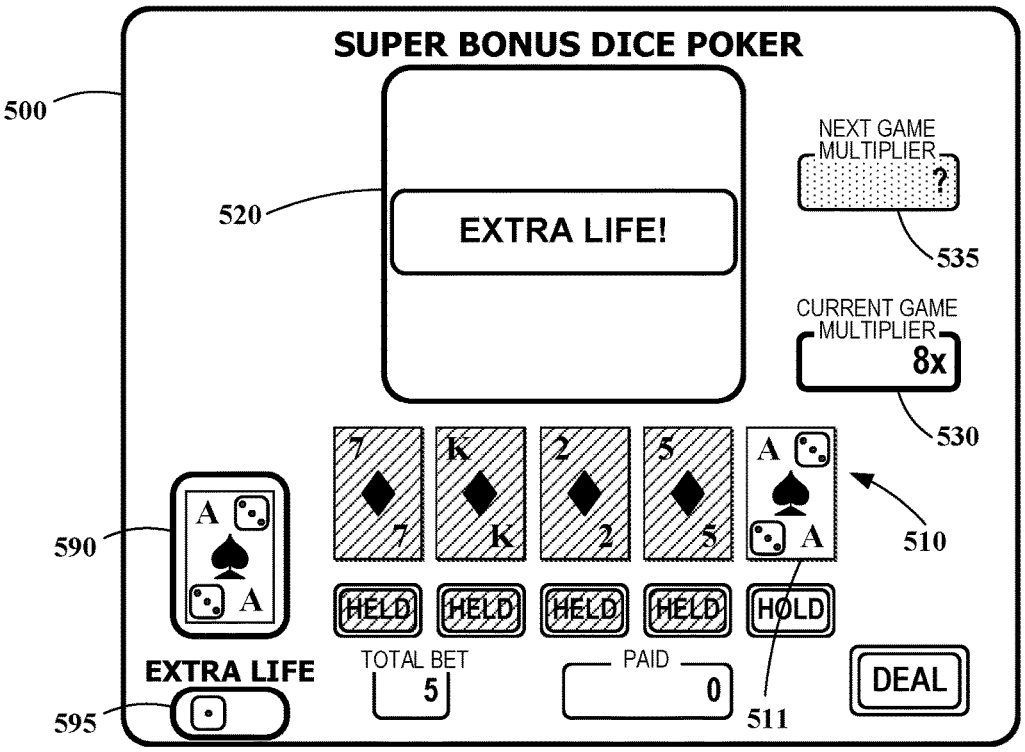

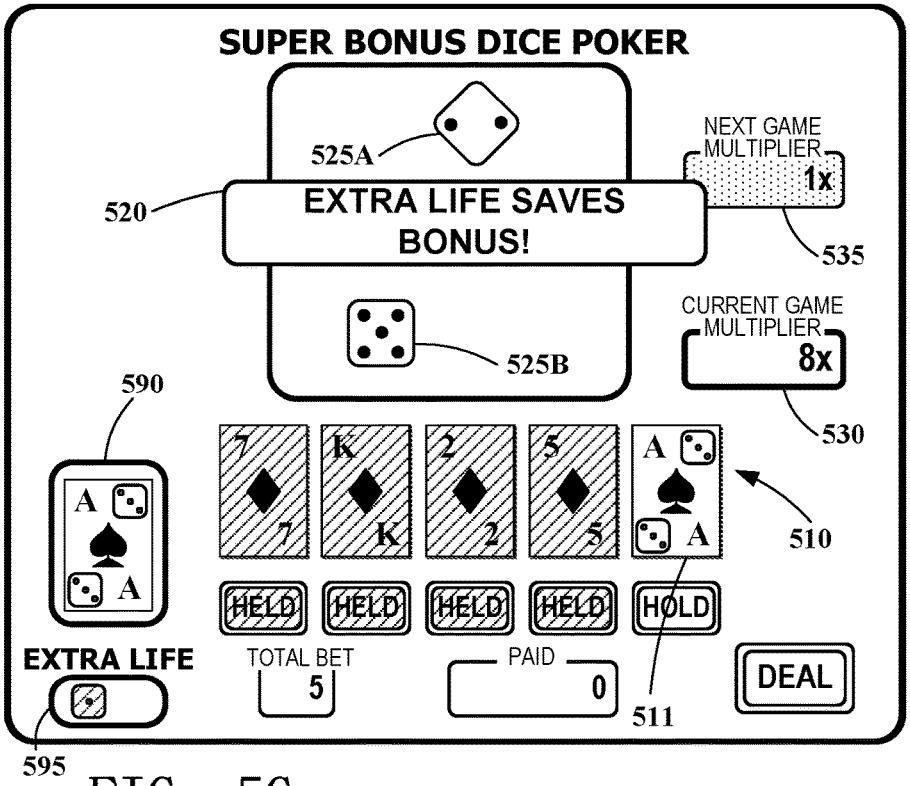
FIG. 5G
FIG. 5H
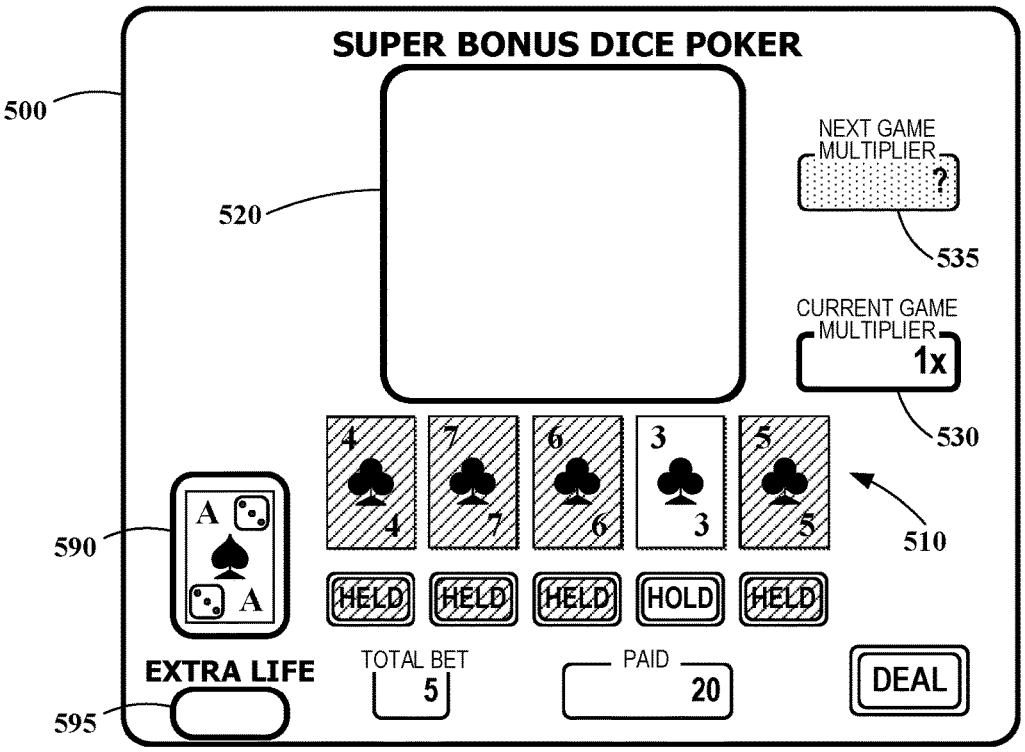

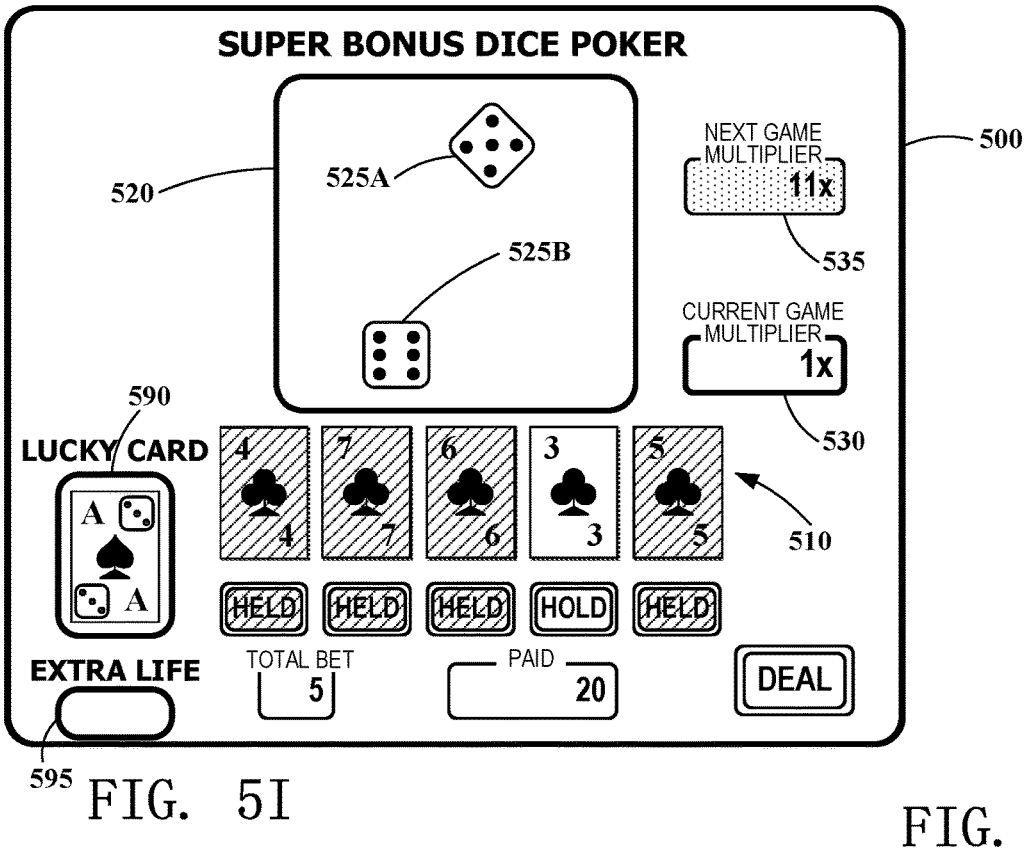
FIG. 5I
FIG. 5J
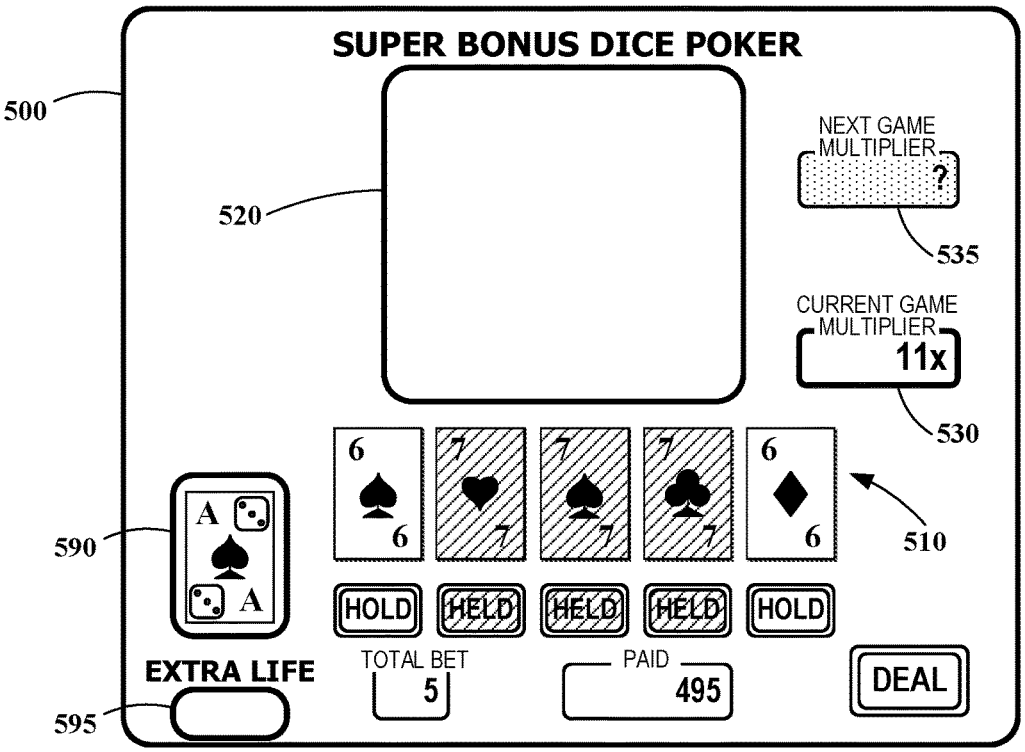

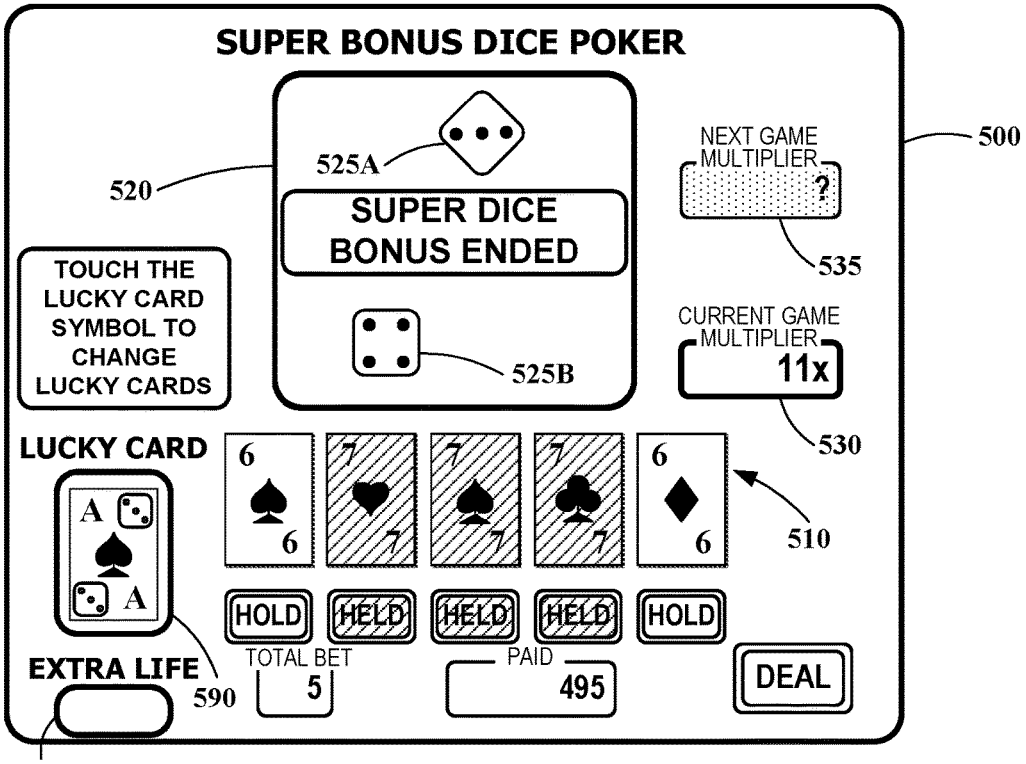
FIG. 5K
FIG. 5L
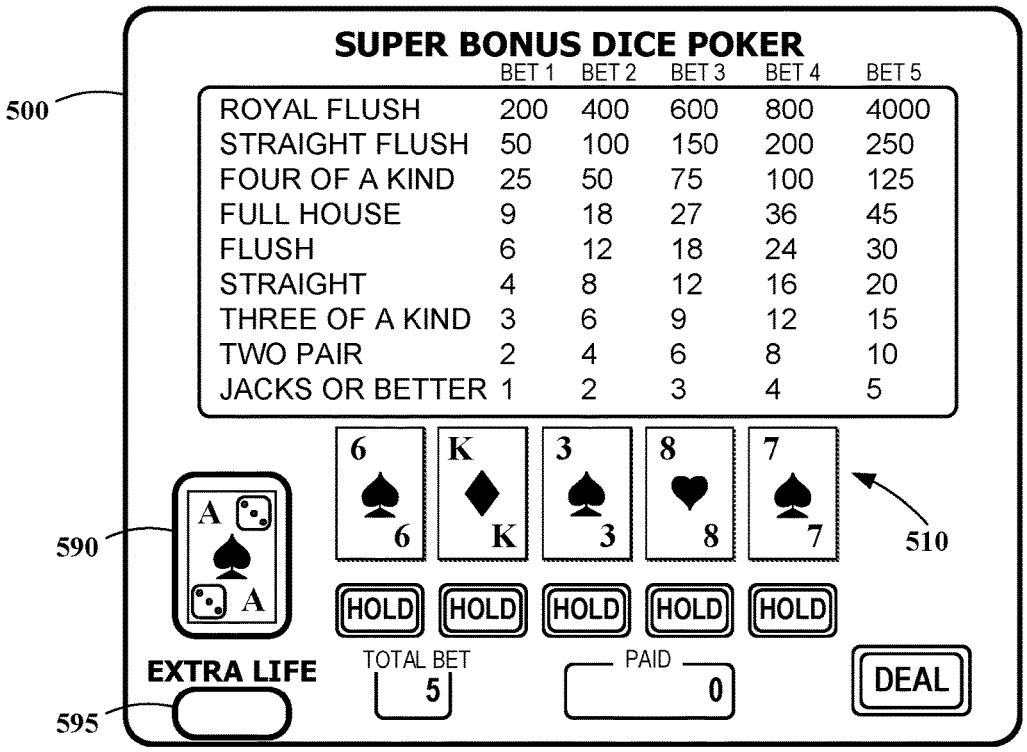
| | BET 1 | BET 2 | BET 3 | BET 4 | BET 5 |
|---|---|---|---|---|---|
| ROYAL FLUSH | 200 | 400 | 600 | 800 | 4000 |
| STRAIGHT FLUSH | 50 | 100 | 150 | 200 | 250 |
| FOUR OF A KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

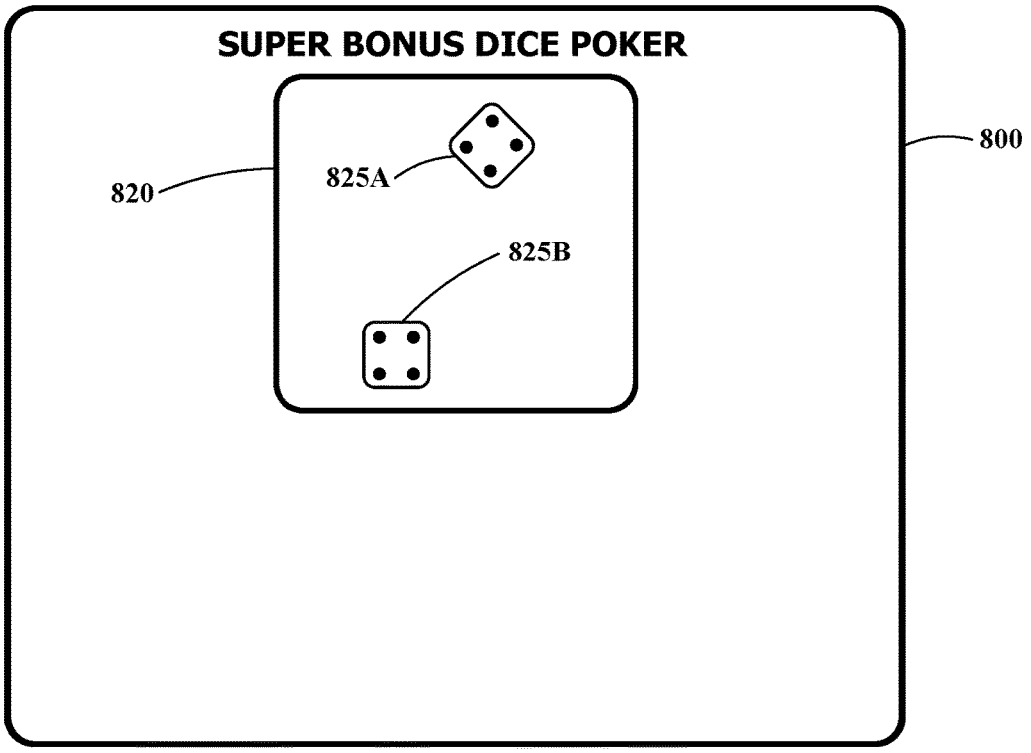
FIG. 8A
FIG. 8B
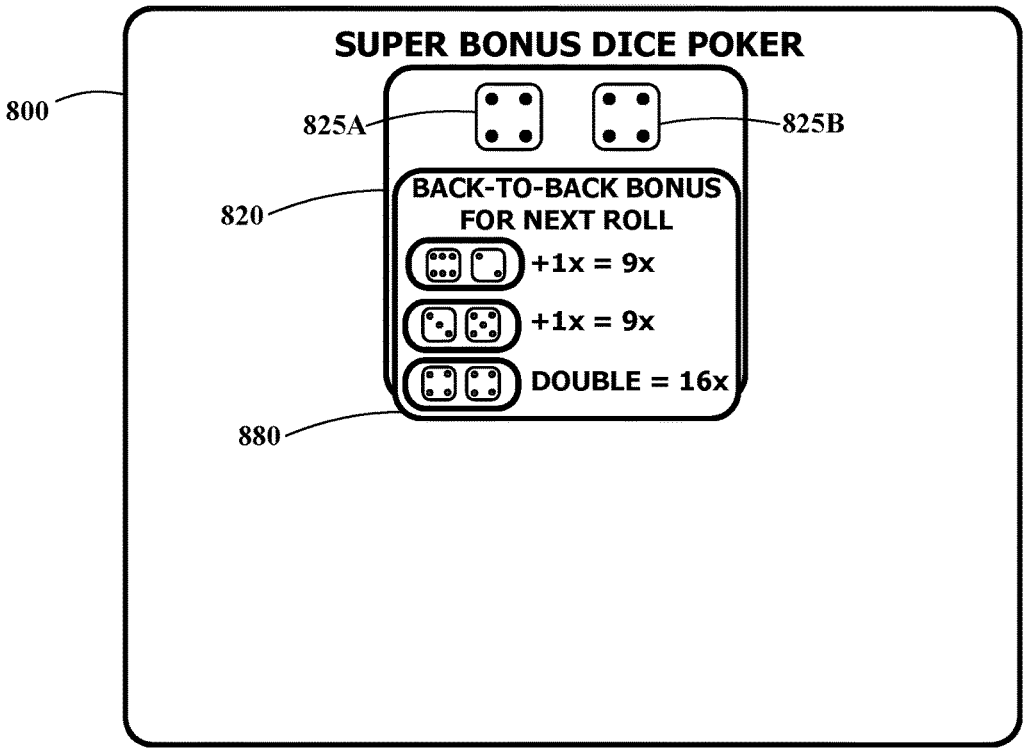

SYSTEMS, APPARATUSES AND METHODS FOR ENHANCING GAMING EXPERIENCES

RELATED APPLICATIONS

This application is a continuation of U.S. application Ser. No. 13/952,273, filed on Jul. 26, 2013, now U.S. Pat. No. 9,569,273, which is a continuation-in-part of U.S. application Ser. No. 13/938,178, filed on Jul. 9, 2013, now U.S. Pat. No. 9,576,437, which claims the benefit of Provisional Patent Application No. 61/708,183, filed on Oct. 1, 2012, to which priority is claimed pursuant to 35 U.S.C. § 119(e), and which is also a continuation-in-part of U.S. application Ser. No. 12/850,826 filed on Aug. 5, 2010, now U.S. Pat. No. 9,576,431, which claims benefit of Provisional Patent Application No. 61/231,951, filed on Aug. 6, 2009, all of which are incorporated herein by reference in its entirety.

FIELD

This invention relates in general to games, and more particularly to systems, apparatuses and methods for providing game features, such as slot game features.

BACKGROUND

It is desirable to provide captivating gaming opportunities for game players to maintain player interest, particularly where there are multiple chances of winning and/or increasing payout awards. In furtherance of the need to attract participants to particular gaming machines, there is a continuing need to further the excitement and anticipation in the participation of gaming activities. The present invention fulfills these and other needs, and offers advantages over prior art gaming approaches.

SUMMARY

To overcome limitations in the prior art described above, and to overcome other limitations that will become apparent upon reading and understanding the present specification, the present invention discloses systems, apparatuses and methods for providing game features.

In accordance with one embodiment, a method is provided that includes facilitating participation in a gaming event, determining if a die/dice feature is triggered during the gaming event, and if the feature is triggered, determining a modifier that is used to modify outcomes in a subsequent gaming event. The die/dice feature includes presentation of one or more dice to facilitate an award-enhancing opportunity, where the award-enhancing opportunity is used to modify an outcome of a subsequent gaming event rather than an outcome of the current gaming event.

In a more particular example of this method, a primary or base game may be a poker game where a die/dice feature multiply is triggered randomly or by an aspect of the result of a current poker game. Here, the method includes receiving signals from the user interface to place a wager on a first poker game and determining with the processor if a bonus dice feature is triggered. If the bonus dice feature is triggered, the game then determines a dice value outcome and associates the dice value outcome with a bonus multiplier. A second poker game is then played, and the game outcome for the second poker game is modified by the bonus multiplier from the bonus dice feature. The bonus dice feature may continue to a third poker game, where another dice roll may be used to determine another bonus multiplier for use in modifying the outcome of the third poker game; or another determination may be made as to whether another dice feature is triggered in the second poker game. In the continuation embodiment, the bonus dice feature may continue until a termination condition is activated. In the separate trigger embodiment, a determination may be made within each game as to whether a dice feature is triggered to determine a bonus multiplier for use with a subsequent poker game.

In another representative variation, multiple hands of poker are presented as a primary game where a die/dice feature is used to multiply or modify at least one of the multiple poker hands when the die/dice feature is triggered.

Other embodiments involve a computer-readable medium(s) that has instructions stored thereon that are executable by a computing system by performing functions associated with any of the method embodiments described herein.

These and various other advantages and features of novelty are pointed out with particularity in the claims annexed hereto and form a part hereof. However, for a better understanding of the operation and advantages, reference should be made to the drawings which form a further part hereof, and to accompanying descriptive matter, in which there are illustrated and described representative examples of systems, apparatuses, and methods associated with the invention.

BRIEF DESCRIPTION OF THE DRAWINGS

The description herein refers to embodiments illustrated in the following diagrams.

FIGS. 2A-2H are diagrams of a game display showing an example game progression according to embodiments of the invention.

FIGS. 5A-5L are diagrams of a game display showing another example game progression according to embodiments of the invention.

FIGS. 8A-8E are diagrams of a portion of a game display showing examples of game enhancement opportunities according to embodiments of the invention.

DETAILED DESCRIPTION

Figure 1:
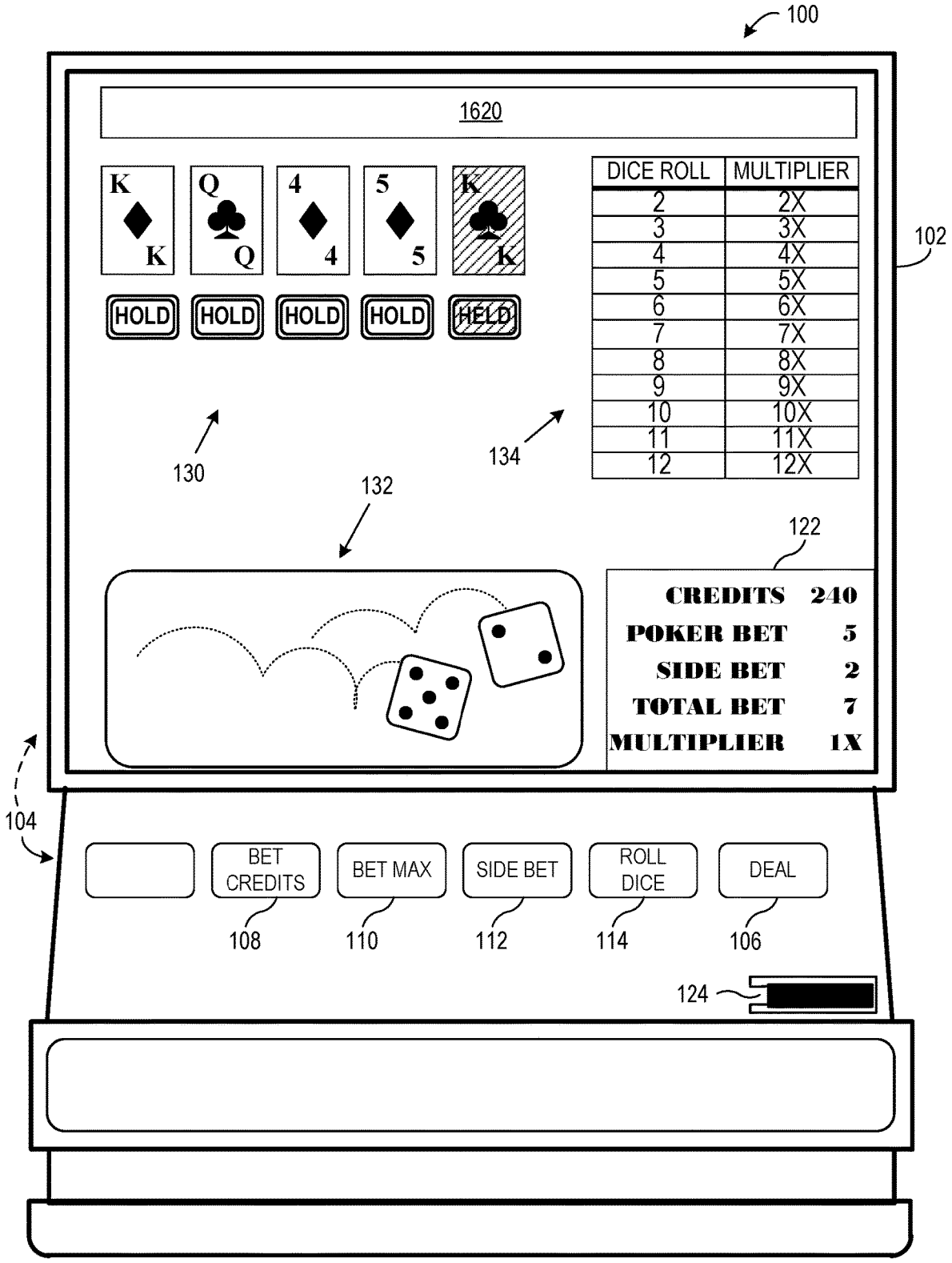
FIG. 1 illustrates a representative embodiment of a gaming device in which the principles of the present invention may be implemented.

In the following description of various exemplary embodiments, reference is made to the accompanying drawings which form a part hereof, and in which is shown, by way of illustration, representative embodiments in which the invention may be practiced. It is to be understood that other embodiments may be utilized, as structural and operational changes may be made without departing from the scope of the invention.

In addition, it is noted that this application incorporates the following applications by reference: U.S. application Ser. No. 13/938,178, filed on Jul. 9, 2013; Provisional Patent Application No. 61/708,183; U.S. application Ser. No. 12/850,826, filed on Aug. 5, 2010; and Provisional Patent Application No. 61/231,951. The embodiments discussed below include various features discussed in detail in these earlier applications. Particular reference is made below to various features and embodiments in U.S. application Ser. No. 13/938,178, although they may also appear in one of the other applications with additional details. For ease of reference, U.S. application Ser. No. 13/938,178 will be referred to hereinafter as "the '178 application."

Generally, systems, apparatuses, and methods are provided for enhancing winning result opportunities in individual or group gaming activities. Embodiments involve identifying award-enhancing opportunities using an actual or virtual die/dice during a first game, and then providing a game modifier as a result of the award-enhancing opportunities to a subsequent second game.

For example, one representative method is used in connection with a gaming event, such as a poker game where payouts are provided for certain cared combinations in a poker hand. A die/dice is presented when an award-enhancing opportunity is triggered, and a game modifier, such as a multiplier, is identified in response to the die/dice "roll," where the game modifier is usable for a subsequent game. In such an embodiment, the die/dice presentation and corresponding award-enhancing opportunities may be allowed to repeat, thereby aggregating award-enhancing opportunities, until the die/dice provide a result that triggers the end of the award-enhancing opportunities. In this manner, payout opportunities are enhanced during the gaming event for a future gaming event.

Note that the '178 application discusses many embodiments where award-enhancing opportunities are used to identify game modifiers for use with the same game event in which they are triggered. While the present application focuses on embodiments where the award-enhancing opportunity is used to enhance a subsequent or future gaming event, the features of these embodiments could also be used to modify a current gaming event in other embodiments. Additionally, while poker embodiments are primarily discussed in the present application, these concepts could also be applied to slot games, video blackjack games, keno games, or any other type of gaming device where wagers are received on a gaming event.

Some embodiments involve an apparatus configured to enhance awards/payouts in such a manner. For example, a display may be configured to present the die/dice, and a processor may be configured to identify award-enhancing opportunities in response to the die/dice presentation. In such an example, the processor may be configured to allow the die/dice presentation and corresponding award-enhancing opportunities to repeat, and aggregate the award-enhancing opportunities, until the die/dice provide a result that triggers the end of the award-enhancing opportunities. The processor may also be configured to calculate payouts that are statistically, or at least perceived to be, more likely to occur.

Another representative method presents a die/dice, and identifies a mathematical augmentation value in response to a number presented on the die/dice. Some number of repetitions of the die/dice presentations (e.g., "rolls") and resulting mathematical augmentation value identifications are guaranteed. An example is to guarantee four free games in the primary game, where each free game is also associated with one of the dice rolls and mathematical augmentation value identifications. In this embodiment, following the guaranteed number of repetitions of dice rolls and mathematical augmentation value identifications, conditional repetition of the presentation of the die/dice and mathematical augmentation value identification is provided until a triggering event occurs by way of the presentation of the die/dice. Payout opportunities relative to the participation in the gaming event may be enhanced using the identified mathematical augmentation values.

The systems, apparatuses and methods described herein may be implemented as a single game, or part of a multi-part game. For example, the games described herein may be implemented in a primary poker or slot game, and/or in a bonus game(s) or other secondary games associated with the primary game. Thus, while various embodiments described herein may be described in terms of a bonus event of a gaming activity, it is equally applicable to main/primary gaming and other non-bonus events. The invention may be used as a stand-alone game, a primary/base game of a poker or slot game, a bonus game associated with a poker or slot game, a community bonus game for a gaming system having multiple gaming devices, etc.

FIG. 1 illustrates a representative embodiment of a poker-style gaming device in which the principles of the present invention may be implemented. Referring to FIG. 1, a gaming machine 100 includes a computing system (not shown) to carry out operations according to the invention. The illustrated gaming machine 100 includes a display 102, and a user interface 104, although some or all of the user interface 104 may be provided via the display 102 in touch screen embodiments.

The user interface 104 allows the user to control and engage in play of the gaming machine 100. The particular user interface mechanisms associated with user interface 104 is structured, in this embodiment, for play of video poker. For example, the user interface 104 may include one or more buttons to hold cards and deal/draw cards, although other functions may be used with other types of poker games. In addition, the user interface 104 may allow the user to enter coins, bills, or otherwise obtain credits through vouchers, tokens, credit cards, tickets, etc. It is through the user interface 104 that the user can initiate and engage in gaming activities involving embodiments described herein. For example, the user can use the user interface 104 and/or touch screen inputs to deal 106 a poker hand, and/or draw a replacement cards in a draw poker embodiment. Additionally, the player may be able to bet 108 a number of credits on each hand wagered, make gaming decisions such as place a maximum wager 110 or place secondary or side bets 112, initiate when the die/dice will be rolled 114, etc. For example, in one embodiment, the user may be eligible for the roll dice feature described herein when placing a maximum wager, or placing a side bet, or other condition for eligibility. In other embodiments, there is no such eligibility, and the player may be eligible to receive the roll dice feature in the normal course of participating in the gaming event, which may or may not be based on rules indicating when the roll dice feature will be presented to the player. While the illustrated embodiment of FIG. 1 depicts various "buttons" for the user interface 104, it should be recognized that a wide variety of user interface options are available for use in connection with the present invention, including pressing buttons, touching a segment of a touch-screen, entering text, entering voice commands, or other known user entry methodology.

The display device 102 may include one or more of an electronic display, and fixed display information such as information such as paytable information associated with a glass/plastic panel 120 on the gaming machine 100. A display segment or panel 122 may also be provided to display information such as the accumulated credits, wager amount on the poker hand, and side bets, the total wager placed, multiplier values such as a multipliers received through the dice feature described herein, the number of credits paid out or "won" on a particular play, etc. A wager acceptor 124 is operative to receive wager tokens, coins, bills, credit/debit cards, coupons, smart cards, prepaid casino cards, electronic fund transfer (EFT), tickets, and the like.

In the illustrated embodiment, the gaming machine is involved in a poker gaming event 130 that may represent the primary or native gaming event in which the player is participating. In this embodiment, the gaming event 130 is depicted to be a draw poker game, where a player may use touch screen buttons or buttons on the user interface 104 to hold cards and deal/draw cards. As previously described, embodiments described herein involve a roll dice feature that may be depicted at display area 132 where the resulting state of the dice may be presented (although audio and/or other manners of notifying the player of the resulting dice roll may instead or additionally used). Depending on the embodiment, a table 134 or other potential award notification area may be provided to enable the participant to know the results of the dice roll feature during participation in the feature and/or after the feature has concluded.

In the illustrated embodiment, the table 134 shows that for a single roll of the dice, a player receives the value of the resulting dice as a multiplier for a subsequently played poker game 130. That is, any awards won in a subsequent poker game, such as the next played poker game, is multiplied by the received multiplier from the previous game. In other embodiments, the multiplier may not be directly associated with the number shown on the dice. For example, a table, such as the one shown in FIG. 10 of the '178 application may be used, where a player can win up to "10×" an award received in the primary poker game, or not win any multiplier if a "7" is received on the dice roll. As mentioned above, a player may receive only a single roll of the dice to generate a multiplier for modifying any awards won in a subsequent poker game, or multiple rolls may be generated to accumulate a multiplier, bonus credits, free games, etc. as described above.

In some embodiments, multiple poker hands may be played during the same primary game. For example, in a "Triple-Play" poker game, three poker hands are provided where cards held in the first poker hand are also revealed and held in the other two poker hands. When a draw is requested, separate replacement cards are used to replace non-held cards in each of the three poker hands. Separate decks may be used to determine the replacement cards for each hand, or a common deck may be used for all replacement cards. If a dice feature is triggered in a multiple poker hand embodiment, the multiplier or modifier awarded in the dice feature may be used to multiply or modify awards won on corresponding poker hands in a subsequent poker game. Alternatively, the multiplier or modifier awarded in the dice feature may be used to only modify the highest winning hand of the multiple hands in the next poker game, or may multiply or otherwise modify one or more of the awards associated with the multiple hands in the next game according to other rules. In other embodiments, each hand may have a separate set of dice used to generate a multiplier or other modifier, or the same set of dice may be rolled multiple times to generate multipliers or modifiers for each hand or poker level. FIGS. 7A-7E below show one example embodiment utilizing multiple poker hands in a single poker game. However, types of multi-hand poker games may also utilize modifiers or multipliers associated with die/dice feature as discussed in this application.

Although single device embodiments are shown in this application, this concept may also be used in a community setting, such as the one shown in FIGS. 15A-15D of the '178 application. In a community bonus embodiment, players may have separate sets of dice to roll, or each player's die/dice may be used together to generate a community bonus modifier.

The bonus dice feature may have a mystery or random trigger, or may be trigged by symbols or other conditions occurring on a primary or base game. The dice may be "rolled" by the player, such as by swiping a finger over the touchscreen image of the dice, or the dice may be auto-rolled by the gaming device. Some embodiments may allow the player to choose whether to roll the dice themselves, or have the dice "auto-rolled." In other embodiments, a dice feature may be used in as a community bonus for a group of poker games using features similar to those described above for tournament or community bonus games. These and other features will be discussed in more detail below with reference to example game progressions and flow charts.

FIGS. 2A-2H are diagrams of a game display showing an example game progression according to embodiments of the invention. The game progression shown in FIGS. 2A-2H includes a dice bonus feature that is randomly triggered at the end of each played poker game. Dice outcomes are associated with bonus multiplier awards that are saved and used to modify any awards won in the base game of the next played poker game. Although this example progression includes a random trigger for the dice bonus feature, other embodiments may include a feature trigger based on a card received in the final poker hand, on a type of poker hand received, based on a mystery "lucky coin" determination, or on other types of triggering events. In this example progression, the dice feature is played following the display of the outcome of the current poker game, but may, in other embodiments, occur before play of the current poker game, during play of the current poker game, or at any other time between the initiation of the current poker game and the completion of the current poker game. Additionally, in this example game progression, a number of dice used in the dice bonus feature is randomly selected prior to rolling the selected dice. This feature may be based on a weighted table or otherwise skewed so that the dice bonus feature is more likely to have a certain number of dice, as well as limiting the minimum and maximum number of potential dice. In this present example, the player may receive between one and four dice to roll during the bonus dice feature. The result of the dice roll is directly associated with a multiplier that is used to modify any awards won in the next poker game played. Each game will include a determination if a dice feature is triggered to provide a multiplier for the following poker game.

Referring to FIG. 2A, a game display 200 includes a poker hand 210 that is played using five card draw poker rules. A dice bonus feature is triggered when, in this embodiment, a current poker game has completed and a random determination is made. Here, a random number is identified, and the bonus feature is triggered if the identified random number falls within a predetermined range. As shown in FIG. 2A, a current game has completed, a triggering condition for the bonus feature has been satisfied, and a bonus message 212 is shown to the player on the game display 200. After the bonus has been triggered, a bonus roll zone 220 (or bonus display 220), a dice start area with one or more dice 225, and a multiplier meter 207 become active for determining a multiplier for the next poker base game, as shown in FIG. 2B.

In this embodiment, the final poker outcome for the current poker game is replaced with card backs so the player does not associate the multiplier with the current poker game outcome. However, in other embodiments (such as those shown below in FIGS. 5A-5J) the final poker outcome may continue to be displayed while the bonus feature is being played. In this instance, after the dice feature has been triggered, a random selection determines that a single die will be used in this dice bonus feature. The player may activate the dice 225 by swiping their finger across the display screen 200 to mimic rolling the dice toward the roll zone 220.

Referring to FIG. 2C, the die 225 has been activated and moves to the roll zone 220 where is lands so that a value of "5" is displayed. This outcome is associated with a multiplier of "5×," which is displayed in the multiplier meter 207. In FIG. 2D, the player has placed another wager, and now has the opportunity to use the multiplier indicated in the multiplier meter 207 to modify any awards won in that second poker game. In this case, the result of the second poker hand is a pair of Kings with an associated award of 5 credits. However, this 5 credit award is multiplied by the "5×" multiplier shown in the multiplier meter 207 for a final award of 25 credits. Another random determination is made to see if a dice bonus feature is again triggered. In this instance, however, one has not been triggered. Thus, the third poker game wagered on by the player (and shown in FIG. 2E) does not have a multiplier to modify any awards won during the game. In this third game, the player has won two pair with an award of 10 credits. Again the bonus feature is not triggered, and the player plays a fourth poker game (shown in FIG. 2F) as normal. The bonus is not triggered again, and the player plays a fifth poker game (shown in FIG. 2G) with no multiplier. However, at the end of this fifth poker game it is determined that bonus feature has been triggered, as shown by the bonus message 212. In this instance, it is determined that the player will roll three dice (225A, 225B, and 225C) for a bonus multiplier for use on the next (sixth) poker game. As shown in FIG. 2H, the bonus feature resulted in the three dice (225A, 225B, and 225C) showing a "4," a "3," and another "4" for a total of 11, which is associated with the "11×" multiplier shown in the multiplier meter 207. The result of the sixth poker game is also shown in FIG. 2H. Here, the player has received a full house outcome on the final poker hand. The 45 credits normally associated with a full house outcome is multiplied by the "11×" multiplier for a total win of 495 credits.

Although the embodiments of FIGS. 2A-2H have the dice associated with multipliers, other modifiers or awards are possible in other embodiments. For example, some or all of the combined dice outcomes may be correlated to credit values, free games/spins/hands, bonus symbols to be used in the base game, or other types of awards. In one example, rolling doubles may be associated with multipliers while rolling other dice combinations may be associated with bonus credits that are won for subsequent poker or slot games. In another example, doubles received on rolls with two dice may be split and re-rolled, such as shown in FIGS. 12A-12C in the '178 application.

In yet other embodiments, the triggering condition for the bonus feature may include evaluating the current poker hand to determine if the player receives a dice roll for a modifier in the next poker hand. For example, a player may need to receive a winning hand (or a hand above a certain threshold) to be eligible for another dice roll in the next poker game. This may also be used in multi-hand embodiments, where each level or hand of the multi-hand game may be used to determine if the corresponding level or hand of a subsequently-played poker game receives a dice roll for a new multiplier/modifier, or maintains the same multiplier/modifier from the previous game at the same level or hand. For example, in a "Triple-Play" poker embodiment, where the first and third hands have winning final poker hands, the player may get to roll dice prior to the cards in the next poker game being shown to receive multiplier for the first and third hands of that next poker game. However, since the hand at level two (or the second hand) did not result in a win, the second hand or level in the subsequent poker game is not associated with a multiplier or modifier. One example embodiment of a multi-hand poker game is discussed below in conjunction with FIGS. 7A-7E.

Figure 3:
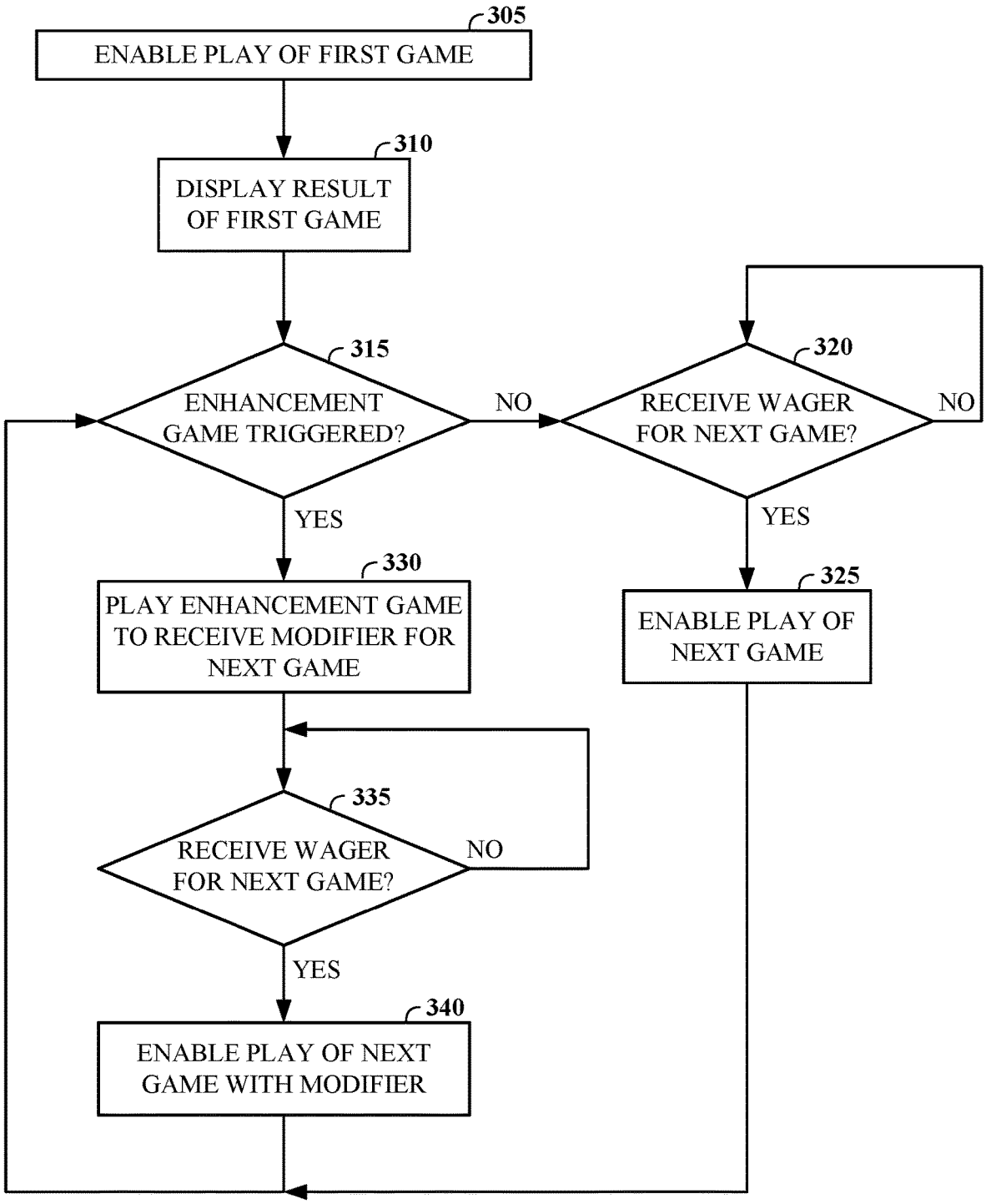
FIG. 3 is a flow diagram of a representative embodiment in which award opportunities are enhanced for a subsequent gaming event according to embodiments of the invention.

FIG. 3 is a flow diagram of a representative embodiment in which award opportunities are enhanced for a subsequent gaming event according to embodiments of the invention. Although various processes are shown in a particular order in this flow diagram, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device.

Note that this example method is just one embodiment of how a game operation can be implemented. As discussed and shown above, many variations exist which may require additional, less, or different processes to complete. In addition, processes shown in dashed boxes may be optional processes that are included in some embodiments, but not in others.

Referring to FIG. 3, play of a first game is enabled in process 305. This process (305) may include receiving a wager on the first game and a signal-indication to deal a poker hand in a poker game, or spin the reels in a slot game. In process 310, the result of the first game is displayed. This could be a final poker hand in a poker game, or final resting position for reels in a slot game. It is determined in process 315 if an enhancement dice feature is triggered, such as the bonus dice roll feature to achieve a multiplier as described above. If an enhancement game is triggered, the bonus enhancement game is played in process 330 to receive a modifier for the next game. Afterwards, the flow proceeds to process 335 where it is determined if a wager is received for the next game. This process (335) repeats until a wager has been received at which time play of the next game is enabled in process 340. After play of the next game in process 340, the flow returns to process 315 to determine if another enhancement game has been triggered. If an enhancement game is not triggered as determined in process 315, the flow proceeds to process 320 where it is determined if a wager is received for the next game. This process (320) repeats until a wager has been received at which time play of the next game is enabled in process 325. After play of the next game in process 325, the flow returns to process 315 to determine if another enhancement game has been triggered.

Figure 4:
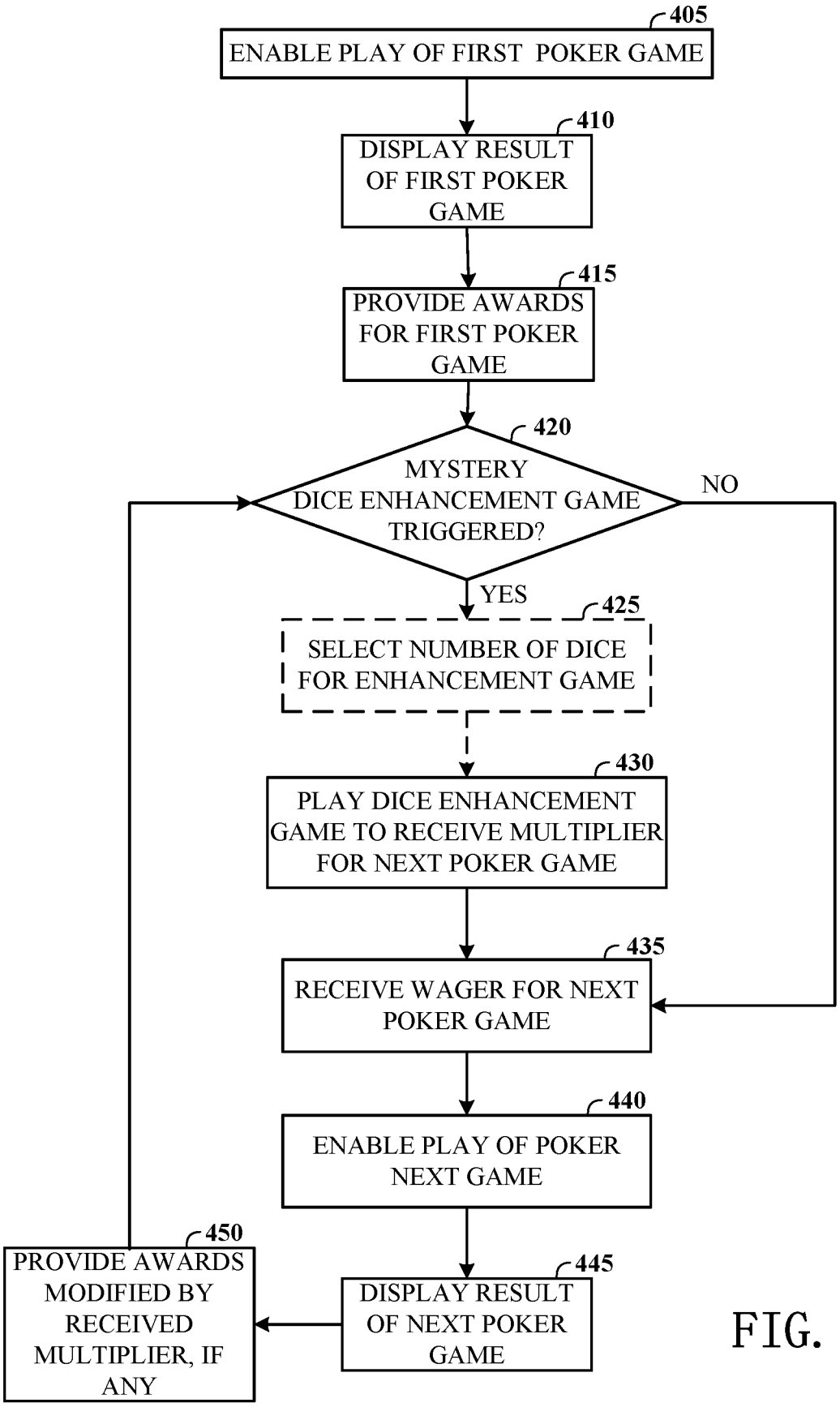
FIG. 4 is a flow diagram of a representative embodiment in which award opportunities are enhanced for a subsequent poker game according to embodiments of the invention.

FIG. 4 is a flow diagram of a representative embodiment in which award opportunities are enhanced for a subsequent poker game according to embodiments of the invention.

Referring to FIG. 4, play of a first poker game is enabled in process 405. This process (405) may include receiving a wager on the first poker game and receiving a signal-indication to deal a poker hand. In process 410, the result of the first poker game is displayed. This could be a final poker hand after a draw in a draw poker game, or another final poker hand in another type of poker game. Awards associated with the outcome of the first poker game are provided in process 415. Here, for example, a paytable may be used to determine if the card combination of the final resulting poker hand in the first poker game is associated with an award. It is then determined in process 420 if a mystery dice enhancement feature is triggered, such as the bonus dice roll feature to achieve a multiplier as described above. The mystery nature of this triggering determination in process 420 may use a random number selection or other method such as a mystery "lucky coin" to determine if the dice enhancement feature is triggered.

If an enhancement game is triggered, the flow may include optional process 425 to select a number of dice to be used in the enhancement game. This selection may be made at random, and may be capped within a minimum number of dice and a maximum number of dice. In other embodiments, the player may be able to select the number of dice to roll. There may be advantages or disadvantages to selecting a number of dice to roll. For example, in one embodiment where the play is allowed to select between one or two dice to roll, the player may get a multiplier associated to the value rolled on either the single die or the two dice, but may get no multiplier if the final dice value is "7." Thus, the player may risk the chance of not getting any multiplier or bonus with two dice, but also have the chance to receive a larger multiplier because of the use of the second die. In yet other embodiments, various play criteria may determine how many dice are received in the feature in process 425. For example, play-rate, wager amount, loyalty membership, amount of side bet, or other criteria may be used at least in part to determine how many dice a player receives in the bonus. For instance, a player may place a 2 credit addition wager to be eligible to receive one die to roll in a bonus dice feature or place a 4 credit additional wager to be eligible to receive two dice to roll in the bonus dice feature.

Returning to the flow of FIG. 4, after optional process 425, the method proceeds to process 430 where the dice enhancement feature is placed to receive a multiplier for the next poker game. In process 435, a wager is received to the next poker game. The flow also proceeds directly to process 435 when it is determined that a mystery dice enhancement game is not triggered in process 420. Play of the next poker game is then enabled in process 440, and the result of the next poker game is displayed in process 445. In process 450 awards are provided for outcomes of the next poker game that are associated with prizes. These awards are further modified by the received multiplier if a mystery dice enhancement game was played in the previous poker game (first poker game), and play of that enhancement game resulted in a bonus multiplier. After awards are provided in process 450, the flow returns to process 420 to see if a mystery dice enhancement game is triggered for the next poker game.

FIGS. 5A-5L are diagrams of a game display showing another example game progression according to embodiments of the invention. The example game progression shown in FIGS. 5A-5L uses a trigger condition of a "lucky" card appearing during play of the poker hand to determine if a bonus dice feature is triggered. In addition, once a bonus dice feature is triggered, the player receives two dice to roll to determine a multiplier. Each subsequent poker game will also have a dice roll (where the dice roll returns a multiplier for use with a following poker game) until a terminating roll outcome is received. In this embodiment, the terminating roll is a dice outcome total of "7" with the two dice. A safe first roll (or multiple safe rolls) may allow a "7" to be rolled the first time without terminating the bonus as described in the '178 application. However, in this illustrated embodiment, any rolled "7" terminates the bonus unless an "extra life" icon is active. An "extra life" icon is received when the "lucky card" appears in another poker hand while the bonus dice feature is still active (like a re-trigger in a free-spins bonus). In some embodiments, the player may only accumulate one extra life, while in other embodiments, the any card deemed a lucky card is either removed from a deck (if for example it was a joker or non-traditional playing card) or returned to a normal state (if for example the lucky card is one of the traditional 52 playing cards in a standard deck) during the course of the bonus dice feature. In yet other embodiments, receipt of the "lucky card" may have no effect in the game if it is received when the bonus dice feature is active.

In some embodiments, the "lucky card" may include a subsymbol, such as a dice image, on the face of the card. In other embodiments, multiple cards may be designated as "lucky cards" where a predefined number or combination of "lucky cards" is needed to trigger the enhancement bonus feature. For example, if all "8s" were designated either by the game device or the player as the "lucky cards," a player may have to receive at least two "8s" during a poker hand to trigger the bonus feature.

Referring to FIG. 5A, a game display 500 allows a player to select one of the cards 505 of a standard 52 card deck as a "lucky card" that is used to trigger a bonus dice feature. In some embodiments, a player may have to meet a certain criteria to be eligible to select a lucky card. In other embodiments, a lucky card or triggering card is selected by the gaming device at random prior to each game or periodically. After selection of the "lucky card" the player plays poker games 510 in a conventional manner until the lucky card appears in a final poker hand. As shown in FIG. 5B, a game display 500 may include a lucky card display 590 so that the player remembers which card was selected as the lucky card, and include an extra life meter 595. In the poker game shown in FIG. 5B, the lucky card 511 appears in the final poker hand 510 thereby triggering the bonus dice feature. Note that the player has received a pair of Queens in this poker game and has already been awarded the 5 credits associated with this outcome prior to play of the bonus dice game, which provides a multiplier for the next poker game played.

Referring to FIG. 5C, two dice 525A, 525B are rolled in a roll zone 520 and a current game multiplier meter 530 and a next game multiplier meter 535 are shown on the game display 520. Here, the player has rolled a "2" on the dice, which is associated in this embodiment with a "2×" multiplier. This "2×" multiplier is shown in the next game multiplier meter 535, while the current game multiplier meter shows that there is no multiplier for the current poker game. In FIG. 5D, the next poker game is played, which results in a pair of Jacks. The 5 credit award for the pair of Jacks is multiplied by the "2×" multiplier, which has been moved to the current game multiplier meter 530 at the start of this poker game, to receive a total award of 10 credits. After this poker game has been played, the bonus dice feature continues with another dice roll for a new multiplier for the next poker game. In this instance, the dice outcome shows a value of "8," which corresponds to a "8×" multiplier for the next poker game, as shown in the next game multiplier meter 535.

Referring to FIG. 5F, the next poker game is played and no winning card combinations are received. Hence, the "8×" multiplier is not helpful. However, the player has received the "lucky card" 511 in the final poker hand. As the bonus dice feature is already active, the player receives an "extra life" icon in the extra life meter 595. This "extra life" icon may prevent the bonus dice feature from ending if a "7" is rolled on the dice. This extra life may only be used for the next dice roll, or may be kept indefinitely until a "7" is rolled and it is needed to prevent the feature from ending. After this poker game, the dice are again rolled in FIG. 5G. This time they result in a "7" outcome which would normally end the bonus. However, since the player received the "extra life" icon, the bonus feature continues even though the player only receives a "1×" multiplier for the next hand. Note that the once the "extra life" icon is used, it is removed from the extra life meter 595.

As shown in FIG. 5H, the next poker game results in a straight with an associated award of 20 credits. However, since the multiplier for this game was set at "1×," the player only receives the 20 credits associated with the base award. After the straight award, the player again rolls the dice 525A, 525B. As shown in FIG. 5I, the dice have resulted in a value of "11," which corresponds to an "11×" multiplier for the next poker game, as shown in the next game multiplier meter 535. In the next poker hand the player receives a full house, which has a 45 credit award associated with it. This 45 credit award is multiplied by the "11×" multiplier for a total award of 495 credits. In FIG. 5K, the dice are rolled again to get a multiplier for the next poker hand. This time, the player rolls a "7," but does not have an active "extra life" icon. Thus, the dice bonus feature ends. When the next poker game is played in FIG. 5L, no multiplier is active to enhance any awards won.

In FIG. 5K, a message is displayed reminding the player that they may switch or change their selection of the "lucky card." Here, the player may touch the lucky card display 590 to bring up a screen such as shown in FIG. 5A to select a new "lucky card." In some embodiments, a player may switch "lucky cards" at any time, while in other embodiments, a player may only switch "lucky cards" when a bonus feature is not currently active. In embodiments where the gaming device randomly selects a "lucky card," the device may select a new "lucky card" at the end of each bonus feature, or may switch lucky cards at random or at a predetermined interval.

Figure 6:
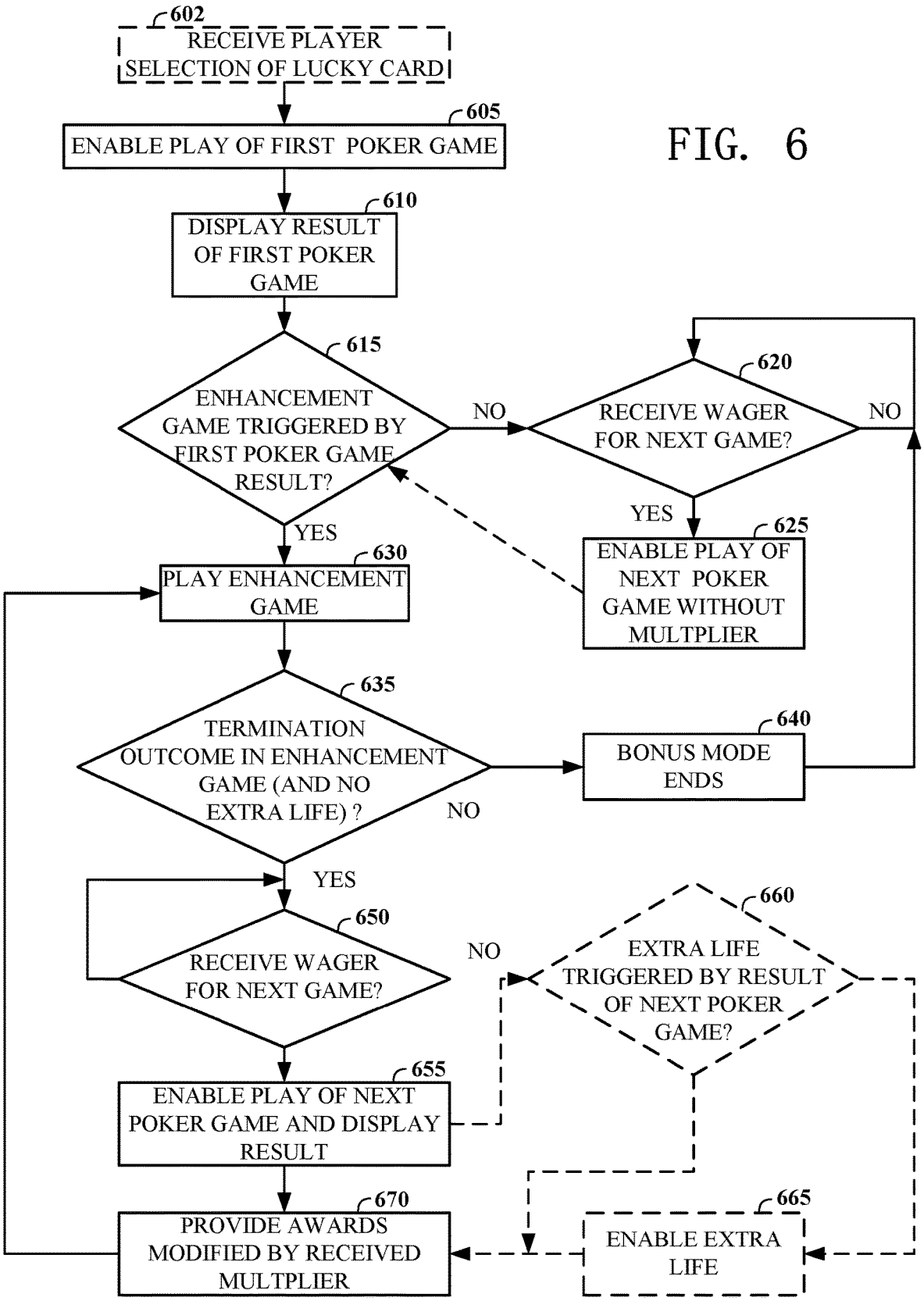
FIG. 6 is a flow diagram of a representative embodiment in which award opportunities are enhanced for a subsequent poker game according to embodiments of the invention.

FIG. 6 is a flow diagram of a representative embodiment in which award opportunities are enhanced for a subsequent poker game according to embodiments of the invention. Referring to FIG. 6, a method optionally begins at process 602 where a lucky card selection made by a player is received. As discussed above, other embodiments may provide other triggering conditions to select a triggering card or other triggering criteria for an enhancement feature. A first poker game is enabled in process 605 and a result of the first poker game is displayed in process 610. In process 615 a determination is made as to whether an enhancement game is triggered by the first poker game result. Here, the determination may be focused on whether the selected lucky card, or other triggering card is included in the final poker hand of the first poker game. Alternatively, the determination in process 615 may as to whether the card combination of the final poker hand meets a threshold condition, such as being a winning poker hand, or a losing poker hand. For example, in some embodiments, the enhancement game is only triggered if the player has had three consecutively losing poker games.

If the enhancement game has not been triggered, the flow proceeds to process 620 to determine if a wager has been received for the next poker game. When a wager is received, play of the next poker game is enabled in process 625. After play of this next poker game, the flow may optionally return to process 615 if the player is eligible for the bonus dice feature. If the enhancement game has been triggered as determined in process 615, the flow proceeds to process 630 where the enhancement game is played. This process (630) may include rolling the dice in the feature. In process 635 it is determined if a termination outcome is received in the enhancement game, and if there are no "extra life" icons active if the embodiment includes the extra-life feature. If a termination outcome is received, such as "7," the flow proceeds to process 640 where the bonus is ended, and then to process 620, which is described above.

If a termination outcome is not received in process 635, the flow proceeds to process 650 to determine if a wager for a next poker game has been received. When the wager is received, play of the next poker game is enabled and a poker hand result is displayed in process 655. In some embodiments, an optional determination is made in process 660 to see if a lucky card is received in the poker hand result to activate or enable an "extra life" icon in optional process 665. Awards are provided in process 670 for the next poker hand, where the awards are modified by the received multiplier from the bonus feature. The flow then returns to process 630 for another roll of the dice. This loop of processes continues until a termination outcome is received in process 635 and no "extra life" icons are active.

Figure 7A:
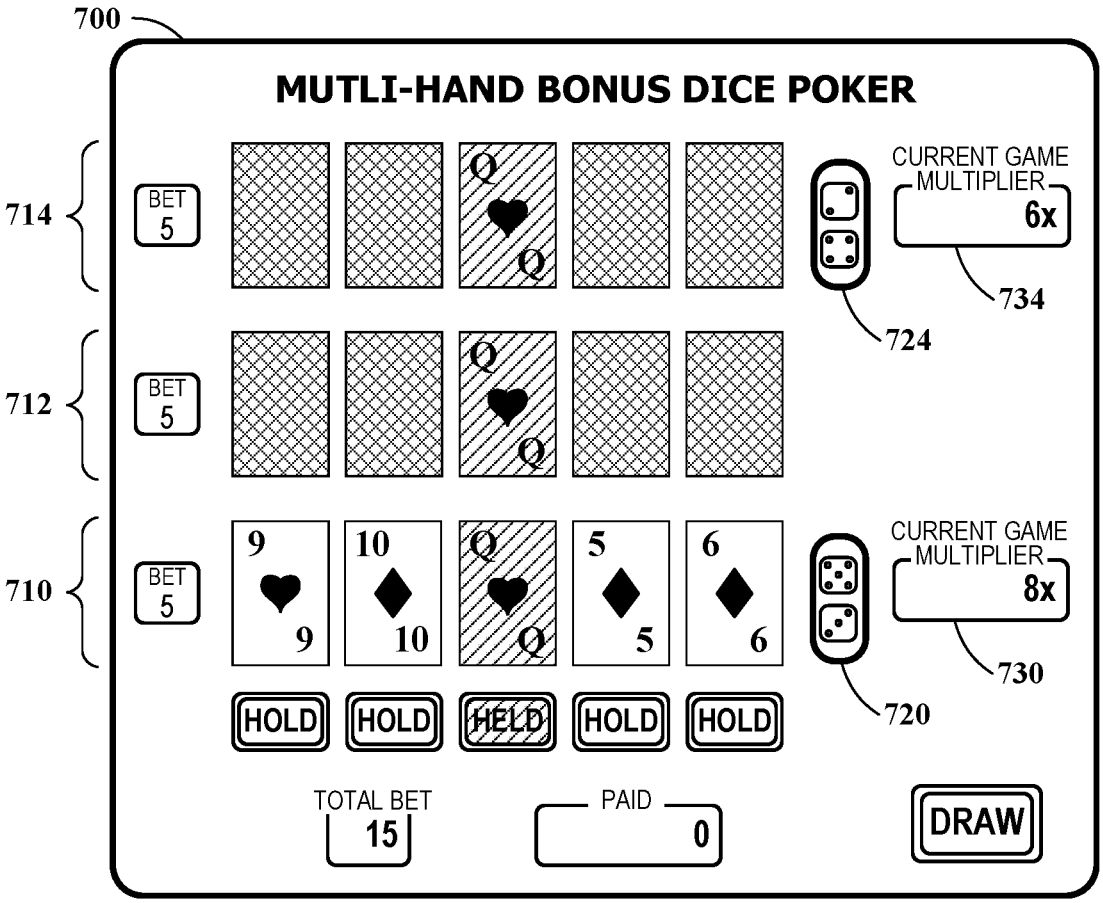
FIGS. 7A-7E are diagrams of a game display showing an example game progression of a multi-hand poker game according to embodiments of the invention.

FIGS. 7A-7E are diagrams of a game display showing an example game progression of a multi-hand poker game according to embodiments of the invention. Multi-hand embodiments have been discussed above, and in the '178 application. FIGS. 7A-7E are provided to illustrate one example game progression for one of these embodiments. Referring to FIG. 7A, a gaming display 700 includes a first poker hand 710, a second poker hand 712, and third poker hand 714. Each of the first, second, and third poker hands 710, 712, 714 have a corresponding roll zone 720, 722, 724 and multiplier meter 730, 732, 734. The roll zones and multiplier meters may only be visible when a bonus feature is active for corresponding poker hand. In this embodiment, the bonus feature is independently active for each hand when a random trigger after each game indicates that a bonus feature is active. Note that rolling a "7" during the enhancement feature game will terminate the bonus for the hand even though it was randomly triggered. Rolls of the dice provide multipliers for the next poker games as discussed above. The bonus dice features are independently triggered for each hand at random, where the determination is made following a current poker game, although as discussed above, other triggering conditions can be used in other embodiments.

Although each bonus dice feature is independent applied to each hand in this embodiment, in other embodiments all hands may use a common dice game and multiplier or the bonus dice feature may be triggered or implemented in combinations between the different poker hands.

In FIG. 7A a bonus dice feature has previously been activated for the first and third poker hands 710, 714 and a game is currently underway. Here, cards are dealt only in the first poker hand 710. When the player holds a card in the first poker hand 710, that card is duplicated in the second and third hands 712, 714. When a draw is made, replacement cards are used to replace any non-held cards in each hand. Each hand 710, 712, 714 may draw from an independent deck of cards, or may draw from a common deck of cards.

Figure 7B:
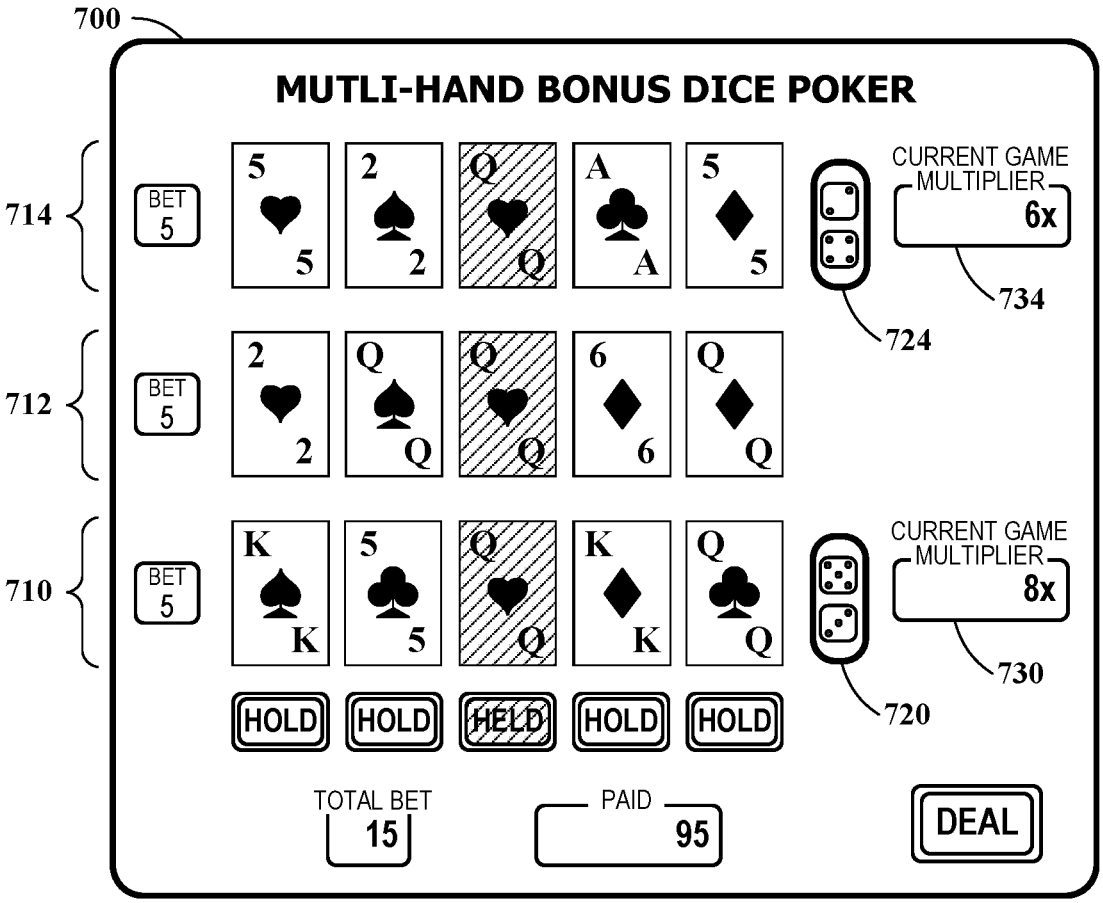

In FIG. 7B, the player has chosen to draw cards in the poker game shown in FIG. 7A after holding the Queen of Hearts. As a result, the player has won a two pair outcome in the first hand 710, which is multiplied by the "8×" multiplier shown in the third multiplier meter 730 for an award of 80 credits. The second hand 712 has resulted in a three-of-a-kind of Queens, which has an award of 15 credits. However, since there is no multiplier associated with the second hand 712, the player only wins 15 credits for the second hand. The third hand 714 does not result in a winning card combination. Thus, despite the "6×" multiplier shown in the third multiplier meter 734, the player does not win any credits for the third hand. Taking the 80 credits from the first hand 710 and the 15 credits for the second hand 712, the player receives a total award of 95 credits.

Figure 7C:
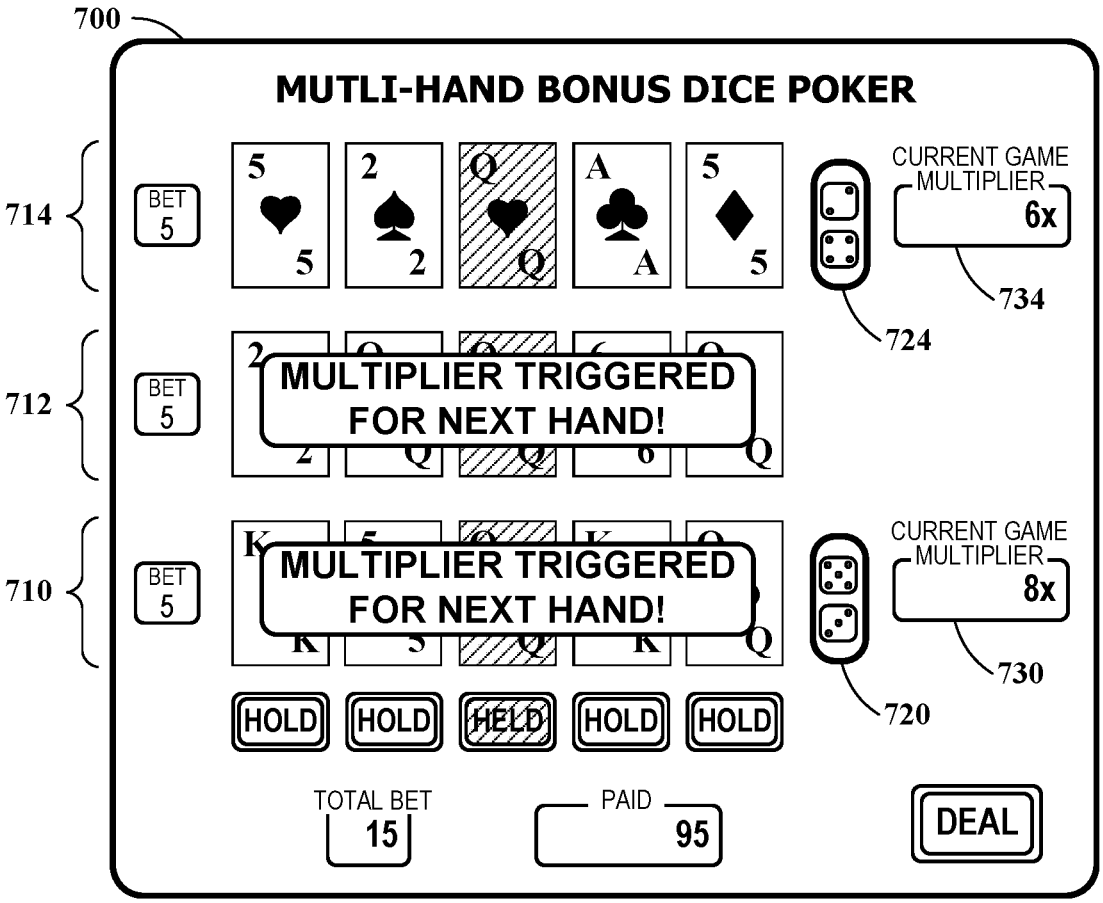
Figure 7D:
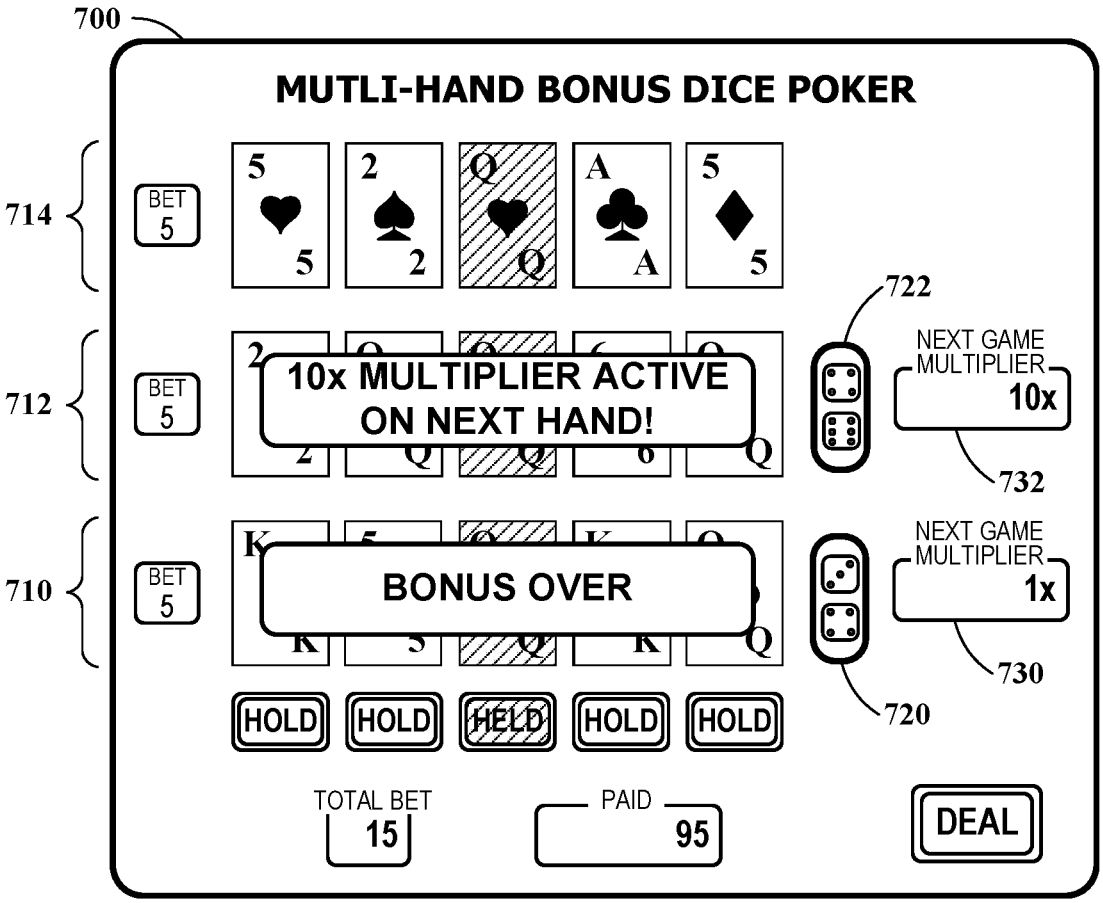
Figure 7E:
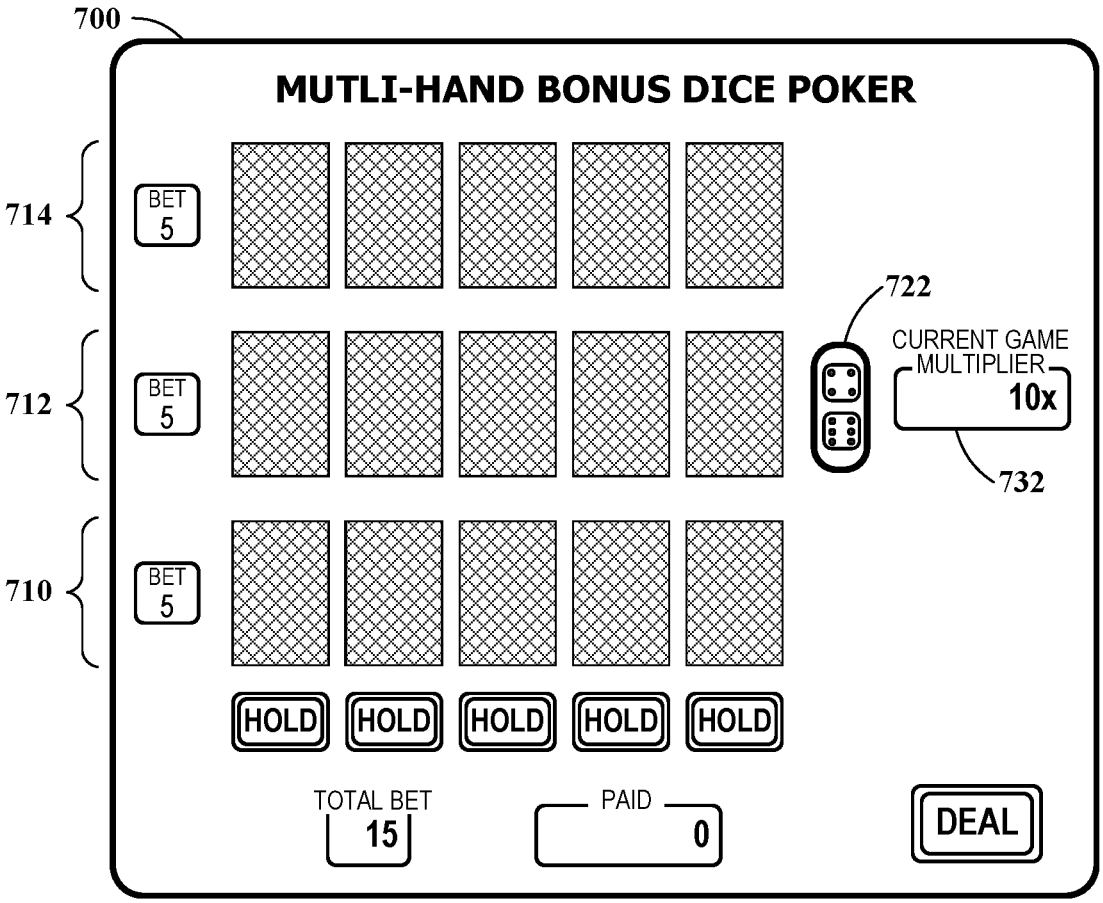

After awarding these credits, a determination is made for each hand 710, 712, 714 to see if a bonus feature is triggered. Here, the bonus feature is triggered for the first and second hand 710, 712, as shown in FIG. 7C. The bonus feature is played for the first and second hands 710, 712 in FIG. 7D. Here, first and second roll zones 720, 722 are activated and two dice are rolled in each of the roll zones. Note that the multiplier meters 730, 732 are re-labeled to show that the received multiplier will be used for poker hands in the next game. Here, the second hand 712 receives a "10" dice value in the second roll zone 722, which correspond to a "10×" multiplier. The first hand, however, receives a "7" in the first roll zone 720, which ends the bonus feature for the first hand. The next game is now wagered on in FIG. 7E. As shown, the first roll zone 720 and multiplier meter 730 have been removed since a "7" was rolled. However, the player still has a chance to have any awards won in the second hand 712 be multiplied by a "10×" multiplier, which builds player anticipation for the game.

Figure 8C:
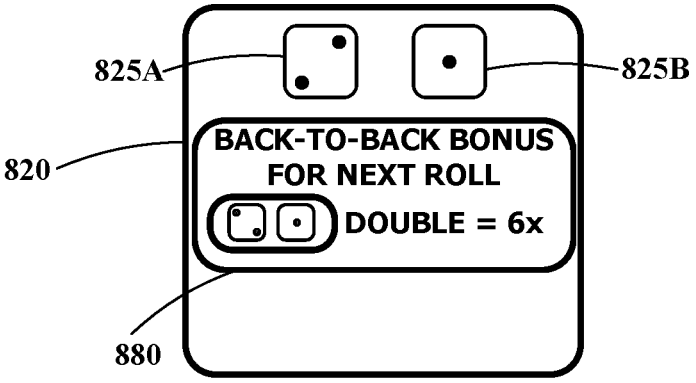

FIGS. 8A-8E are diagrams of a portion of a game display showing examples of game enhancement opportunities according to embodiments of the invention. Referring to FIG. 8, and gaming display 800 includes a roll zone 820 where two dice 825A, 825B are rolled during a bonus dice feature. In this instance, the dice result in a "4" and another "4" for a total dice value of "8" In some embodiments, consecutive rolls of the same total dice value and/or the exact same dice outcomes result in a bonusing of the multipliers or modifiers associated with the dice outcome. FIG. 8B shows one such example after the roll in FIG. 8A. Here a Back-to-Back bonus chart 880 is provided to show additional bonus modifications if the next roll results in the same total dice value or exact same dice outcome. Here, if another total dice value of "8" is rolled in the next consecutive roll, the associated multiplier is incremented up from an "8×" multiplier to a "9×" multiplier. However, if two "4s" are rolled again, the associated multiplier is doubled to "16×." In some embodiments, consecutive rolls may continue to be bonused. Hence, for the above example, if the player rolled another pair of "4s" in the second roll, the player may be eligible for a "17×" multiplier if they roll a third "8" value or a "32×" multiplier if they roll a third pair of "4s." In other embodiments, the back-to-back bonusing is capped a certain number, which can be just for any immediately subsequent roll (i.e., streaks of 3 or more are not given any additional bonusing).

Figure 8D:
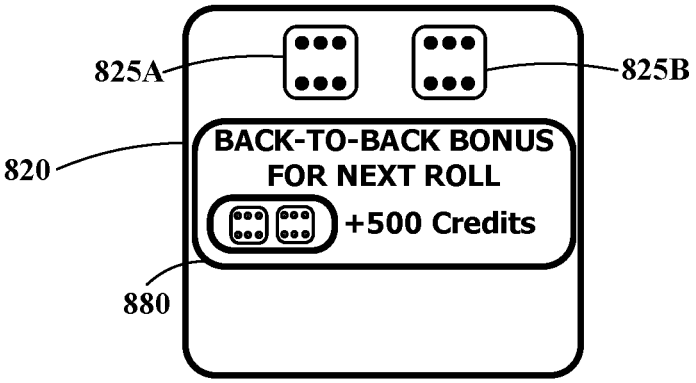
Figure 8E:
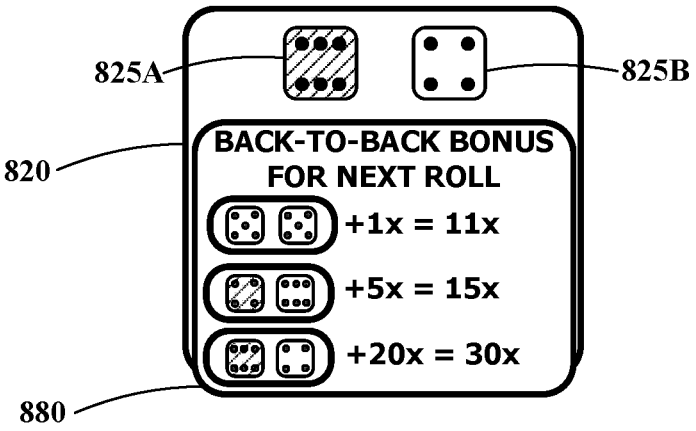

FIGS. 8C, 8D, and 8E show other possible bonusing examples for consecutive rolls of the dice. In FIG. 8C, there are two ways to re-roll a "3," but each include having one die with a "1" and the other die with a "2." Either way is enough to double the normal multiplier value. In FIG. 8D, credits may be given instead of altering a normal multiplier. Hence, the player would receive a "12×" multiplier on the next hand as well as receiving a bonus of 500 credits. In FIG. 8E, the dice and differently colored or shaded so that various outcomes with the same total value can be separated. Here, various modifications of the normal multiplier may be made depending on how closely the dice resemble the first roll.

Figure 9:
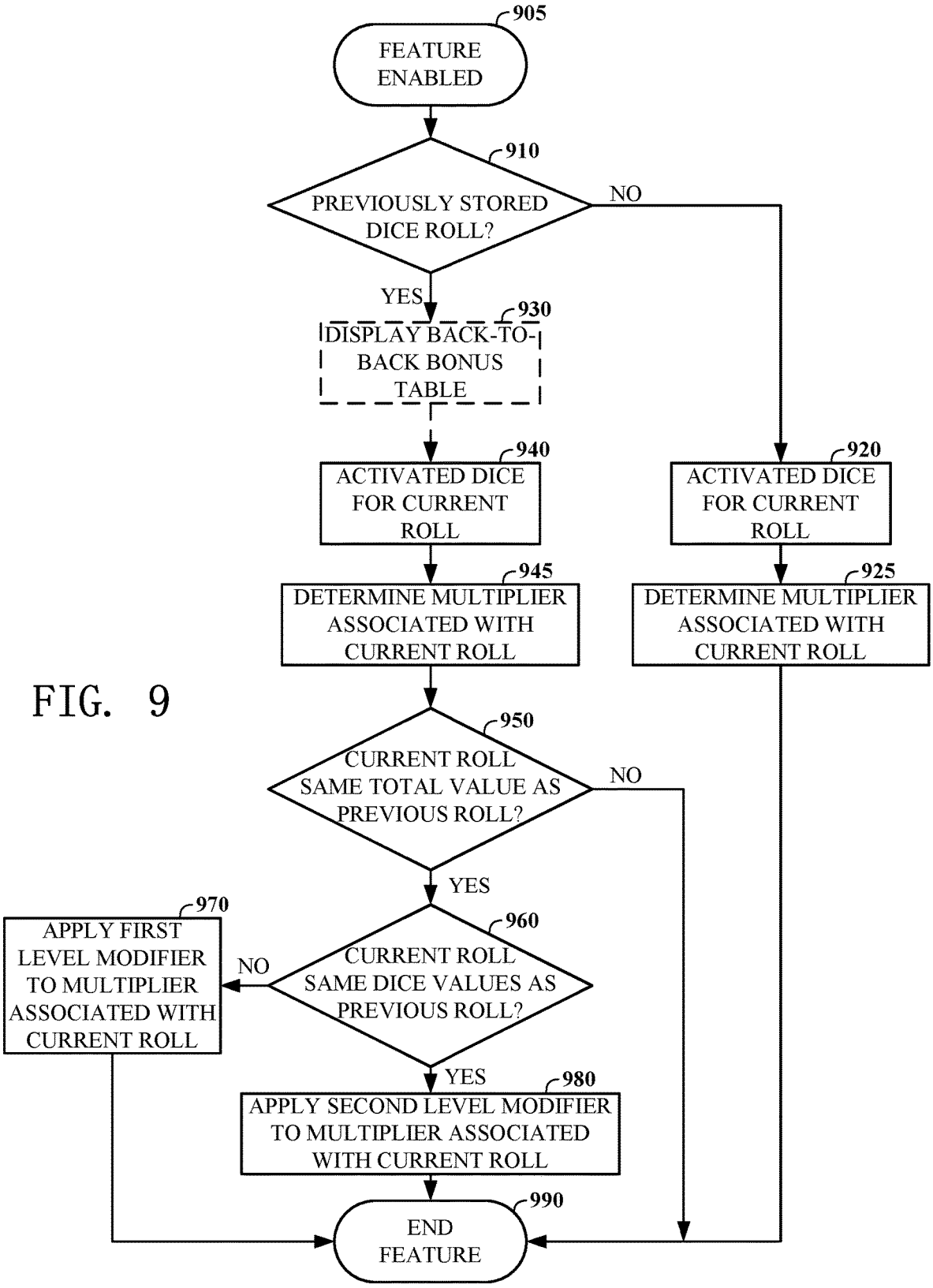
FIG. 9 is a flow diagram of a representative embodiment in which award opportunities are enhanced for a subsequent gaming event according to embodiments of the invention.

FIG. 9 is a flow diagram of a representative embodiment in which award opportunities are enhanced for a subsequent gaming event according to embodiments of the invention.

Referring to FIG. 9, a method is shown with a flow that begins with process 905 where an enhancement feature is triggered. It is then determined if a previous dice roll is stored in memory in process 910. In some embodiments, previous dice rolls may only be active and stored for embodiments that have multiple rounds of dice rolls without the need to retrigger the bonus feature. In other embodiments, the dice rolls may not be stored after a certain number of intervening base games (or even a single intervening base game without the feature being triggered). If a previous dice roll has not been stored, the flow proceeds to process 920 where dice are activated for a current roll, and then to process 925 where a multiplier is determined for the current roll. The flow then proceeds to process 990 where the feature ends. If a previous dice roll has been stored as determined in process 910, the flow proceeds to optional process 930 where a back-to-back bonus table may be displayed to a player to show them the possible bonus modifications associated with rolling the same dice value or outcome as the previous roll.

The dice are then activated in process 940, and a multiplier associated with the current roll is determined in process 945. In process 950 it is determined if the current roll has the same total value as the previous roll. If not, the flow proceeds to process 990 where the feature ends. If the current roll does have the total value as the previous roll, the flow proceeds to process 960 where it is determined if the current roll has the same dice values as the previous roll. If they do not have the same dice values (i.e., the dice have the same total value, but are not the exact same dice values), a first level modifier is applied to the multiplier associated with the current roll in process 970 and the feature ends in process 990. For example, this may be where the multiplier value is incremented by one as shown in FIG. 8B. If the current dice do have the same dice values as the previous roll as determined in process 960, the flow proceeds to process 980 where a second level modifier is applied to the multiplier associated with the current roll, and then the feature ends in process 990. Continuing the above example, this second level modifier may be doubling the normal multiplier as shown in FIG. 8B.

From the description provided herein, those skilled in the art are readily able to combine software created as described with appropriate general purpose or special purpose computer hardware to create a mobile computer system and/or computer subcomponents embodying the invention, and to create a mobile computer system and/or computer subcomponents for carrying out methods of the invention.

The foregoing description of the exemplary embodiments has been presented for the purposes of illustration and description. It is not intended to be exhaustive or to limit the invention to the precise form disclosed. Many modifications and variations are possible in light of the above teachings.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out herein.

What is claimed is:

1. A gaming device comprising:

a display;

a user interface;

a memory configured to store a credit amount;

a wager input device structured to receive physical items associated with currency values; and a processor operable to:

receive a signal from the wager input device indicating receipt of currency or currency based tickets;

increase the credit amount in memory based upon the received signal from the wager input device;

receive a signal on the gaming device to initiate a first poker game having a predefined number of card positions associated with a poker hand, the signal indicating a wager amount, where the credit amount is reduced by the wager amount;

display a result of the first poker game on the display;

evaluate the poker hand for the first poker game to determine first awards associated with the first poker game;

increase the credit amount in memory based on the first awards;

determine, during the first poker game, if a bonus dice feature is randomly triggered, where the determination of whether the bonus dice feature is randomly triggered is independent of the poker hand in the first poker game;

randomly roll at least one die to generate a dice value outcome when the bonus dice feature is triggered;

associate the dice value outcome, if any, with a bonus multiplier;

receive a signal on the gaming device to initiate a second poker game, the signal indicating a wager amount, where the credit amount is reduced by the wager amount;

select a plurality of cards to present in the card positions of the second poker game to form a poker hand;

display a result of the second poker game on the display;

evaluate the poker hand of the second poker game to determine second awards associated with the second poker game;

multiply any determined second awards for the second poker game with the bonus multiplier, if any; and increase the credit amount in memory based on the multiplied second awards.

2. The gaming device of claim 1, wherein multiple dice are used in the bonus dice feature, and wherein the dice value outcome is determined by summing the values shown on faces of the multiple dice as outcomes.

3. The gaming device of claim 1, wherein the bonus multiplier is equal to the dice value outcome.

4. The gaming device of claim 1, wherein a bonus dice feature is triggered when a randomly chosen number falls within a predefined range of numbers.

5. The gaming device of claim 1, further comprising randomly selecting a number of dice to roll prior to determining a dice value outcome.

6. The gaming device of claim 1, wherein the processor is further operable to:

determine if the dice value outcome is associated with a bonus-terminating event that ends the bonus dice feature; and set the bonus multiplier to a "lx" value when the dice value outcome is associated with the bonus-terminating event.

7. The gaming device of claim 1, wherein the processor is further operable to:

determine if the dice value outcome is the same as a predetermined value; and increase the associated bonus multiplier by a predefined amount when the dice value outcome is the same as the predetermined value.

8. A method of operating a gaming device including a display, a user interface, a memory configured to store a credit amount, a wager input device structured to receive physical items associated with currency, and a processor, the method comprising:

receiving a signal from the wager input device indicating receipt of currency or currency based tickets;

increasing the credit amount in memory based upon the received signal from the wager input device;

receiving a signal on the gaming device to initiate a first poker game having a predefined number of card positions associated with a poker hand, the signal indicating a wager amount, where the credit amount is reduced by the wager amount;

displaying a result of the first poker game on the display;

evaluating the poker hand for the first poker game to determine first awards associated with the first poker game;

increasing the credit amount in memory based on the first awards;

determining, during the first poker game, if a bonus dice feature is randomly triggered, where the determination of whether the bonus dice feature is randomly triggered is independent of the poker hand in the first poker game;

randomly rolling at least one die to generate a dice value outcome when the bonus dice feature is triggered;

associating the dice value outcome, if any, with a bonus multiplier;

displaying the bonus multiplier on the display during the first poker game;

receiving a signal on the gaming device to initiate a second poker game, the signal indicating a wager amount, where the credit amount is reduced by the wager amount;

selecting a plurality of cards to present in the card positions of the second poker game to form a poker hand;

displaying a result of the second poker game on the display;

evaluating the poker hand of the second poker game to determine second awards associated with the second poker game;

multiplying any determined second awards for the second poker game with the bonus multiplier, if any; and increasing the credit amount in memory based on the multiplied second awards.

9. The method of claim 8, wherein multiple dice are used in the bonus dice feature, and wherein the dice value outcome is determined by summing the values shown on faces of the multiple dice as outcomes.

10. The method of claim 8, wherein the bonus multiplier is equal to the dice value outcome.

11. The method of claim 8, wherein a bonus dice feature is triggered when a randomly chosen number falls within a predefined range of numbers.

12. The method of claim 8, further comprising randomly selecting a number of dice to roll prior to determining a dice value outcome.

13. The method of claim 8, further comprising:

determining if the dice value outcome is associated with a bonus-terminating event that ends the bonus dice feature; and setting the bonus multiplier to a "1×" value when the dice value outcome is associated with the bonus-terminating event.

14. The method of claim 8, further comprising:

determining if the dice value outcome is the same as a predetermined value; and increasing the associated bonus multiplier by a predefined amount when the dice value outcome is the same as the predetermined value.

15. A method of operating a gaming device including a display, a user interface, a memory configured to store a credit amount, a wager acceptor structured to receive physical items associated with a currency value, and a processor, the method comprising:

receiving a signal from the wager acceptor indicating receipt of a physical item associated with a currency value;

increasing the credit amount in memory based upon the received signal from the wager acceptor;

receiving a signal on the gaming device to initiate a first poker game having a predefined number of card positions associated with a poker hand, the signal indicating a wager amount, where the credit amount is reduced by the wager amount;

displaying a result of the first poker game on the display;

evaluating the poker hand of the first poker game to determine first awards associated with the first poker game;

increasing the credit amount in memory based on the first awards;

determining if a bonus dice feature is triggered based on the first poker game;

randomly rolling at least one die to generate a first dice value outcome when the bonus dice feature is triggered;

ending the bonus dice feature when the first dice value outcome is associated with a terminating condition;

associating the first dice value outcome with a first bonus multiplier when the first dice value outcome is not associated with the terminating condition;

receiving a signal on the gaming device to initiate a second poker game, the signal indicating a wager amount, where the credit amount is reduced by the wager amount;

selecting a plurality of cards to present in the card positions of the second poker game to form a poker hand;

displaying a result of the second poker game on the display;

evaluating the poker hand of the second poker game to determine second awards associated with the second poker game;

multiplying any determined second awards for the second poker game with the first bonus multiplier, if any;

increasing the credit amount in memory based on the multiplied second awards;

randomly rolling the at least one die to generate a second dice value outcome;

ending the bonus dice feature when the second dice value outcome is associated with the terminating condition;

associating the second dice value outcome with a second bonus multiplier when the second dice value outcome is not associated with the terminating condition;

receiving a signal on the gaming device to initiate a third poker game, the signal indicating a wager amount, where the credit amount is reduced by the wager amount;

selecting a plurality of cards to present in the card positions of the third poker game to form a poker hand;

displaying a result of the third poker game on the display;

evaluating the poker hand of the third poker game to determine third awards associated with the third poker game;

multiplying any determined third awards for the third poker game with the second bonus multiplier, if any; and increasing the credit amount in memory based on the multiplied third awards.

16. The method of claim 15, wherein multiple dice are used in the bonus dice feature, and wherein the first dice value outcome and second dice value outcome are respectively determined by summing the values of shown on faces of the multiple dice as outcomes.

* * * * *